US005399465A

United States Patent [19]

Baloga

[11] Patent Number: 5,399,465

[45] Date of Patent: Mar. 21, 1995

[54] METHOD OF PROCESSING REVERSAL ELEMENTS COMPRISING SELECTED DEVELOPMENT INHIBITORS AND ABSORBER DYES

[75] Inventor: John D. Baloga, Rochester, N.Y.

[73] Assignee: Eastman Kodak Company, Rochester, N.Y.

[21] Appl. No.: 4,019

[22] Filed: Jan. 15, 1993

[51] Int. Cl.[6] ..... G03C 7/46

[52] U.S. Cl. ..... 430/379; 430/505; 430/544; 430/957; 430/559; 430/517; 430/359; 430/407

[58] Field of Search ..... 430/957, 505, 544, 517, 430/559, 407, 359, 379

[56] References Cited

U.S. PATENT DOCUMENTS

| | | | |
|---|---|---|---|
| 4,461,826 | 7/1984 | Yamashita et al. | 430/505 |
| 4,480,028 | 10/1984 | Kato et al. | 430/544 |
| 4,482,629 | 11/1984 | Nakagawa et al. | 430/542 |
| 4,557,998 | 12/1985 | Washburn et al. | 430/367 |
| 4,618,571 | 10/1986 | Ichijima et al. | 430/505 |
| 4,680,356 | 7/1987 | Washburn et al. | 526/526 |
| 4,729,943 | 3/1988 | Pfaff et al. | 430/362 |
| 4,746,600 | 5/1988 | Watanabe et al. | 430/505 |
| 4,847,185 | 7/1989 | Begley et al. | 430/376 |
| 4,855,220 | 8/1989 | Szajewski | 430/505 |
| 4,857,440 | 8/1989 | Begley et al. | 430/382 |
| 4,891,304 | 1/1990 | Nakamura | 430/448 |
| 4,956,269 | 9/1990 | Ikeda et al. | 430/505 |
| 4,962,018 | 10/1990 | Szajewski et al. | 430/544 |
| 5,006,448 | 4/1991 | Szajewski et al. | 430/544 |
| 5,024,925 | 6/1991 | Deguchi | 430/505 |
| 5,026,628 | 6/1991 | Begley et al. | 430/382 |
| 5,153,108 | 10/1992 | Ishikawa et al. | 430/372 |
| 5,155,004 | 10/1992 | Kojima | 430/223 |

FOREIGN PATENT DOCUMENTS

| | | |
|---|---|---|
| 0175311 | 9/1985 | European Pat. Off. . |
| 0296784 | 12/1988 | European Pat. Off. . |
| 0296785 | 12/1988 | European Pat. Off. . |
| 0329016 | 10/1989 | European Pat. Off. . |
| 0349331 | 1/1990 | European Pat. Off. . |
| 0383623 | 2/1990 | European Pat. Off. . |
| 0481427 | 4/1992 | European Pat. Off. . |
| 4135312 | 4/1992 | Germany . |
| 4200322 | 7/1993 | Germany . |
| 2010650 | 7/1985 | Japan . |
| 2168142 | 1/1986 | Japan . |
| 3271348 | 4/1987 | Japan . |
| 3271351 | 4/1987 | Japan . |
| 1004743 | 6/1987 | Japan . |
| 1105947 | 10/1987 | Japan . |
| 1180543 | 11/1987 | Japan . |
| 1266539 | 4/1988 | Japan . |
| 2308239 | 5/1989 | Japan . |
| 4121735 | 9/1990 | Japan . |
| 2-251950 | 10/1990 | Japan . |
| 9211575 | 9/1992 | WIPO . |

OTHER PUBLICATIONS

Research Disclosure 15854, vol. 158, Jun. 1977, pp. 35–38.

*Primary Examiner*—Charles L. Bowers, Jr.
*Assistant Examiner*—Geraldine Letscher
*Attorney, Agent, or Firm*—Gordon M. Stewart

[57] ABSTRACT

A reversal photographic element, preferably a color reversal element, is provided with development inhibitors of a defined class, and an absorber dye. The combination improves acutance. The element has a light sensitive layer containing latent image forming silver halide grains, and an inhibitor containing compound in the light sensitive layer or a non-imaging record associated with the light sensitve layer, the compound having the structural formula $$\text{CAR-(TIME)}_n\text{-INH}$$

wherein:

CAR is a carrier moiety from which -(TIME)$_n$-INH is released during color development;

TIME is a timing group;

INH is comprised of a development inhibitor moiety selected from the group defined in the specification, the INH having an inhibitor strength greater than 1. The element is further provided with a dye which absorbs light to which the light sensitive layer is sensitive. Elements of the present invention are preferably processed in a standard reversal process.

15 Claims, No Drawings

METHOD OF PROCESSING REVERSAL ELEMENTS COMPRISING SELECTED DEVELOPMENT INHIBITORS AND ABSORBER DYES

FIELD OF THE INVENTION

The present invention relates to reversal elements, particularly color reversal elements, which use particular development inhibitor compounds and dyes to obtain increased acutance.

BACKGROUND

It is known in the silver halide photographic art that color images having improved sharpness (acutance) can be obtained through the use of development inhibitor releasing compounds. Development inhibitor releasing compounds are often refered to as DIR compounds, which term is used here to include compounds which release an inhibitor containing group with a timing group (often referred to as DIAR compounds). Such compounds react with oxidized color developer (in particular, oxidized primary amino developing agent) to form a colored or non-colored compound while releasing a development inhibitor or a development inhibitor precursor. DIR compounds are to be distinguished from compounds which inhibit development upon exposure of the element to a black and white developer. The use of particular DIR compounds is described, for example, in U.S. Pat. Nos. 4,857,440; 5,006,448; 4,729,943; and EP 0,329,016.

Another means for improving acutance in silver halide film elements, has been the use of a dye which absorbs light in the region to which a particular layer is sensitive and which is placed in or above that layer. It is known that improved acutance of color images can be obtained by addition of water soluble absorber dyes to color negative elements. In addition, combinations of diffusible dyes and DIRs in color negative film are known. The combined use of such a non-diffusible dye in combination with a DIR to improve image sharpness has also been described, particularly in negative working elements, in U.S. Pat. No. 4,855,220. U.S. Pat. No. 4,746,600 also discloses the use of a non-diffusible dye and DIRs to improve image sharpness.

A serious difficulty with the foregoing art is that while DIR compounds in the form of couplers have been employed successfully in negative photographic elements, they have met very limited success in reversal photographic elements. One of the reasons for this is that negative elements are only processed in a color developer to produce a negative dye image. On the other hand, reversal elements are first processed in a black and white developer followed by a fogging step, then a color developer. Currently, the standard process for processing reversal films is the Kodak Process E-6® development described in more detail below, or substantially equivalent processes made available by other manufacturers. Such processes use exhaustive color development. As described by T. H. James, ed., *The Theory of the Photographic Process,* 4th Edition, Macmillan, New York, 1977, page 611, exhaustive color development results in DIR couplers having little effect in color reversal materials. Similarly, U.S. Pat. No. 4,788,132 indicates DIR compounds are not effective in color reversal elements in the statement that the use of a DIR coupler in color reversal materials does not produce any substantial interimage effect since color development is hardly inhibited. While U.S. Pat. No. 4,729,943 describes the use of DIR couplers in color reversal elements, the DIR coupler is incorporated in a layer which does not take part in image formation and the color development time is reduced to between 1 and 2 minutes (that is, the development process is non-standard).

For purposes of this invention, conventional development processes include the E-6 process as described in *Manual For Processing Kodak Ektachrome Films Using E-6*, (1980) Eastman Kodak Company, Rochester, N.Y., or a substantially equivalent process made available by a company other than Eastman Kodak Company, are referred to as "current" color reversal processes or "standard" processes. Current reversal processes employ as a color developer, 4-(N-ethyl-N-2-methylsulfonylaminoethylino)-2-methylphenylenediamine sesquisulfate, 1-hydrate in a concentration of from about 7 to about 11 grams per 1000 ml of water, and as a silver halide solvent, 2,2-ethylenedithioethanol (also known as Dithiaoctanediol) in a concentration of about 0.6 to about 1.2 grams per 1000 ml of water. The pH of the color developing agent is from about 11.6 to about 12.1. The color developing agent is used in the process for about from 5.5 to 7.0 minutes at a temperature of from 36.6° to 39.4° C.

It should be noted at this point that color reversal films have higher contrasts and shorter exposure latitudes than color negative film. Moreover, such reversal films do not have masking couplers, and this further differentiates reversal from negative working films. Furthermore, reversal films have a gamma generally between 1.5 and 2.0, and this is much higher than for negative materials.

It would be desirable then to have a color reversal film with enhanced acutance but which can still be processed through standard color reversal processes (which, as described above, are exhaustive).

SUMMARY OF THE INVENTION

The present invention provides a reversal photographic element (preferably color) which can be processed through a standard development process (that is, an exhaustive process), and which has good acutance resulting from the use of a dye in conjunction with specific types of DIR compounds. Further, the present invention allows construction of photographic elements with selective control over the spatial frequencies at which acutance improvements occur in color reversal films processed in a standard process. Note that for the purposes of the present invention, when the element is a black and white element, it is either one which exhibits a black and white dye image or a silver image produced by use of a color developer.

The present invention then, is a reversal photographic element comprising:

a) a light sensitive layer containing latent image forming silver halide grains;

b) an inhibitor containing compound in the light sensitive layer or a non-imaging record associated with the light sensitive layer, the compound having the structural formula $$\text{CAR-(TIME)}_n\text{-INH} \qquad \text{(I)}$$

wherein:

CAR is a carrier moiety from which -(TIME)$_n$-INH is released during color development;

TIME is a timing group;

INH is comprised of a development inhibitor moiety selected from the group consisting of oxazole, thiazole, diazole, oxathiazole, triazole, thiatriazole, benzotriazole, tetrazole, benzimidazole, indazole, isoindazole, mercaptotriazole, mercaptothiadiazole, mercaptotetrazole, selenotetrazole, mercaptothiazole, selenobenzothiazole, mercaptobenzoxazole, selenobenzoxazole, mercaptobenzimidazole, mercaptobenzothiazole, selenobenzimidazole, benzodiazole, mercaptooxadiazole, or benzisodiazole, the INH of the compound having an inhibitor strength greater than 1 (one) referred to herein as a strong inhibitor; and n is 0, 1 or 2;

c) a dye which absorbs light to which the light sensitive layer of the element is sensitive.

The present invention also includes a method of processing elements of the foregoing type. The method comprises first treating such an element with a black and white developer to develop exposed silver halide grains, then fogging non-exposed grains, followed by treating the element with a color developer.

EMBODIMENTS OF THE INVENTION

It is preferred that reversal elements of the present invention have at least two light sensitive silver halide emulsion layers, and that the inhibitor containing compound is incorporated into one of those layers.

In reversal elements of the invention, it is also preferred that the dye is positioned either in a layer above the light sensitive layer or in the light sensitive layer itself. For example, if the light sensitive layer is sensitive to red light, the dye would be a red absorbing dye preferably positioned above or in the red sensitive layer. Similarly, where the light sensitive layer is a green or blue sensitive layer, the dye would respectively be a green or a blue absorbing dye preferably positioned above or in the green or blue sensitive layer, respectively. Note that when reference is made to a dye absorbing in the same color as the color sensitivity of the light sensitive layer, this means that the dye absorbs light of a wavelength within the region of color sensitivity (the dye preferably absorbing in a substantial portion of the region of color sensitivity).

Although both diffusible and non-diffusible dyes are well known, and either type can be used to practice this invention, it is preferred to use diffusible dyes in the photographic elements of the present invention. This will mean in a typical element that the dye is water soluble. Further, the diffusible dye need not necessarily be initially placed in the layer in which it is desired, since it will diffuse into that layer. Thus, in the present invention when a particular light absorbing dye is referenced as being in a particular layer it may also, of course, be in other layers (and generally will be in all the other layers in the case of the preferred diffusible dyes).

The preferred photographic elements of the present invention preferably have a conventional tri-color construction. That is, they preferably have a red sensitive layer containing a cyan coupler, a green sensitive layer containing a magenta coupler, and a blue sensitive layer containing a yellow coupler. The DIR compound can be in any of those layers or an interlayer (that is, a non-imagin layer) associated with one of the color sensitive layers. By "associated" is meant that is in a position such that the DIR can react with oxidized color developer produced by a layer and release the inhibitor to affect that layer or another light sensitive layer. Such elements may have both red and green, or even red, green and yellow, absorber dyes.

As to the types of dyes which may be used in the elements of the present invention, as previously discussed such dyes are preferably diffusible. Dyes of the foregoing type are described in U.S. Pat. No. 4,956,269.

As to the amounts of absorber dyes that might be used, although wide ranges could be used in the present invention, it is preferred that for at least one light sensitive layer there is an amount of absorber dye which reduces the speed of that light sensitive layer by between 0.05 logE to 0.5 logE, and more preferably between 0.1 logE to 0.3 logE. In particular, where the photographic element is of the conventional tri-color construction described above, there would be at least a red absorber dye, a green absorber dye or a blue absorber dye present in the element in an amount sufficient to reduce the speed of the corresponding light sensitive layer by between 0.05 logE to 0.5 logE, and more preferably by 0.1 logE to 0.3 logE. Preferably, there is a red absorber dye, a green absorber dye and a blue absorber dye all present in the element each in an amount which reduces the speed of its corresponding light sensitive layer (that is, red sensitive layer, green sensitive layer, and blue sensitive layer, respectively) by 0.05 logE to 0.5 logE and more preferably by 0.1 logE to 0.3 logE. One disadvantage of using high levels of absorber dyes is the photographic speed loss it causes and therefore the preferred range will be a tradeoff between sharpness benefit versus photographic speed loss.

The method of processing a color reversal element of the present invention comprises first treating the element with a black and white developer to develop exposed silver halide grains. The element is then treated with a color developer. Such developing process is preferably a standard process (particularly the E-6 process) as described above.

The present invention provides for the use of absorber dyes with strong inhibitors or inhibitor fragments.

As to the use of strong inhibitors, although not bound by any theory, it is believed that the strong inhibitors or inhibitor fragments released during the color reversal process is a color development inhibitor which is sufficiently strong to allow image modification that results in increased sharpness to take place and improved color reproduction, e.g. increasing saturation in one color without substantially increasing color saturation in a similar color, for example, saturating reds while not substantially saturating flesh color and thus maintaining more accurate reproduction of flesh color. That is, the inhibitors have to be selected carefully to obtain the improved image modification.

Thus, the very strong inhibitor fragments released by compounds employed in this invention enable the use of the E-6 type development process with DIR compounds or couplers of the invention with desirable image modifying advantages.

The inhibitor number, IN, of the INH compound is defined as:

$$IN = \frac{D_{max}\text{ (solution } A) - D_{max}\text{ (solution } B)}{D_{max}\text{ (solution } A)} \times 100$$

wherein IN is greater than 35 and is preferably greater than 50 with a typical IN being about 60.

The inhibitor strength, IS (also referred herein as inhibitor potency), of the INH compound is defined as:

$$IS = \frac{IN_{(test)}}{IN_{(control)}}$$

where $IN_{(test)}$ is the inhibitor number determined by the method described above for any INH compound of interest, and $IN_{(control)}$ is the inhibitor number determined for the test coating when 1-phenyl-5-mercapto-1,2,3,4-tetrazole is the INH compound incorporated into the color developer. In the present invention IS equal to or greater than 1 (one) and is preferably greater than 1.2 with a typical IS being about 1.6.

It has been found that compounds having the structural formula $$\text{CAR-(TIME)}_n\text{-INH}$$

wherein INH comprises a compound that has a inhibitor strength greater than 1 provide particularly desirable results when incorporated into color reversal photographic elements.

DIR compounds can be employed in the color reversal photographic element of the invention, preferably in the cyan dye-forming unit, and more preferably in a fast red-sensitive silver halide layer in said cyan dye-forming unit. Such development inhibitors useful in the invention are disclosed in U.S. Pat. No. 5,151,343, incorporated herein by reference. Mercaptotetrazole and mercaptooxadiazole inhibitors are especially preferred.

Linking or timing groups, when present, are groups such as esters, carbamates, and the like that undergo base-catalyzed cleavage, including anchimerically assisted hydrolysis or intramolecular nucleophilic displacement. Suitable linking groups, which are also known as timing groups, are shown in the previously mentioned U.S. Pat. No. 5,151,343 and in U.S. Patent Nos. 4,857,447, 5,021,322, 5,026,628, and the previously mentioned 5,051,345, all incorporated herein by reference. Preferred linking groups are p-hydroxymethylene moieties, as illustrated in the previously mentioned U.S. Pat. No. 5,151,343 and in Coupler DIR-1 of the instant application, and o-hydroxyphenyl substituted carbamate groups.

CAR groups includes couplers which react with oxidized color developer to form dyes while simultaneously releasing development inhibitors or inhibitor precursors. Other suitable carrier groups include hydroquinones, catechols, aminophenols, aminonaphthols, sulfonamidophenols, pyrogallols, sulfonamidonaphthols, and hydrazides that undergo cross-oxidation by oxidized color developers. DIR compounds with carriers of these types are disclosed in U.S. Pat. No. 4,791,049, incorporated herein by reference. Preferred CAR groups are couplers that yield unballasted dyes which are removed from the photographic element during processing, such as those disclosed in the previously mentioned U.S. Pat. No. 5,151,343. Further, preferred carrier groups are couplers that yield ballasted dyes which match spectral absorption characteristics of the image dye and couplers that form colorless products.

In one embodiment of the invention, a threecolor reversal element has the following schematic structure:

(13) Second protective layer containing matte
(12) First protective layer containing UV-absorbing dyes
(11) Fast blue-sensitive layer containing blue-sensitive emulsion and yellow coupler
(10) Slow blue-sensitive layer containing blue-sensitive emulsion and yellow coupler
(9) Yellow filter layer
(8) Intermediate layer
(7) Fast green-sensitive layer containing green-sensitive emulsion and magenta coupler
(6) Slow green-sensitive layer containing green-sensitive emulsion and magenta coupler
(5) Intermediate layer
(4) Fast red-sensitive layer containing red-sensitive emulsion and cyan coupler
(3) Slow red-sensitive layer containing red-sensitive emulsion and cyan coupler
(2) Intermediate layer
(1) Antihalation layer Support with subbing layer In the following discussion of suitable materials for use in the emulsions and elements of this invention, reference will be made to *Research Disclosure*, December, 1989, Item 308119, published by Kenneth Mason Publications, Ltd., Dudley Annex, 12a North Street, Emsworth, Hampshire, P010 7DQ, UK, the disclosures of which are incorporated herein by reference. This publication will be identified hereafter by the term *Research Disclosure*.

Couplers which form cyan dyes upon reaction with oxidized color-developing agents are described in such representative patents and publications as U.S. Pat. Nos. 2,772,162; 2,895,826; 3,002,836; 3,034,892; 2,747,293; 2,423,730; 2,367,531; 3,041,236; and 4,333,999; and Research Disclosure, Section VII D. Preferably, such couplers are phenols and naphthols.

Couplers which form magenta dyes upon reaction with oxidized color developing agents are described in such representative patents and publications as: U.S. Patent Nos. 2,600,788; 2,369,489; 2,343,703; 2,311,082; 3,152,896; 3,519,429; 3,062,653; and 2,908,573; and *Research Disclosure*, Section VII D. Preferably, such couplers are pyrazolones and pyrazolotriazoles.

Couplers which form yellow dyes upon reaction with oxidized and color developing agents are described in such representative patents and publications as: U.S. Pat. Nos. 2,875,057; 2,407,210; 3,265,506; 2,298,443; 3,048,194; and 3,447,928; and *Research Disclosures*, Section VII D. Preferably, such couplers are acylacetamides such as benzoylacetanilides and pivaloylacetanilides.

Couplers which form colorless products upon reaction with oxidized color developing agents are described in such representative patents as: UK Patent No. 861,138; U.S. Pat. Nos. 3,632,345; 3,928,041; 3,958,993; and 3,961,959. Preferably, such couplers are cyclic carbonyl-containing compounds which react with oxidized color developing agents but do not form dyes.

The image dye-forming couplers can be incorporated in photographic elements and/or in photographic processing solutions, such as developer solutions, so that upon development of an exposed photographic element they will be in reactive association with oxidized color-developing agent. Coupler compounds incorporated in photographic processing solutions should be of such molecular size and configuration that they will diffuse through photographic layers with the processing solution. When incorporated in a photographic element, as a general rule, the image dye-forming couplers should be nondiffusible; that is, they should be of such molecular size and configuration that they will not significantly wander from the layer in which they are coated.

Photographic elements of this invention can be processed by conventional techniques in which color-forming couplers and color-developing agents are incorporated in separate processing solutions or compositions or in the element, as described in *Research Disclosure*, Section XIX.

The DIR compounds of the invention are highly desirable because they generate more interimage at higher densities than lower densities. That is, the DIR compounds of the invention have the effect of reproducing certain colors or high relative chroma, e.g. reds, while enabling reproduction of related colors, e.g. flesh colors, with less relative increase in saturation or chroma when used in a color image forming layer or in a non-color image forming layer.

Preferred INH groups of the invention can be selected from the group having the following structures:

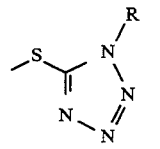

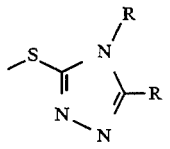

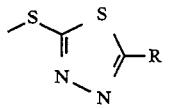

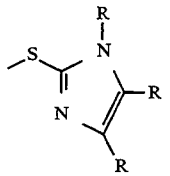

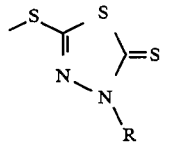

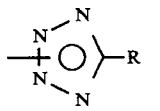

-continued

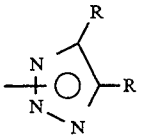

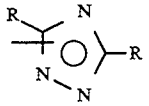

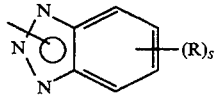

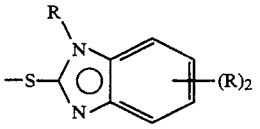

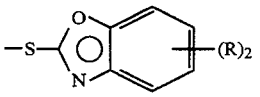

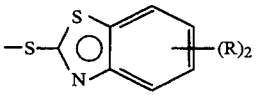

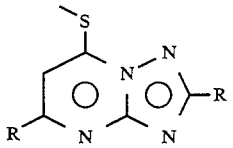

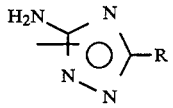

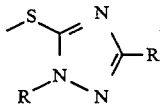

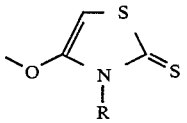

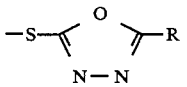

wherein R is an alkyl group, hydrogen, halogen (including fluorine, chlorine, bromine and iodine), an aryl group, or a 5- or 6-membered heterocyclic ring, alkoxy group, aryloxy group, alkoxycarbonyl group, aryloxycarbonyl group, amino group, sulfamoyl group, sulfonamido group, sulfoxyl group carbamoyl group, alkylsulfo group, arylsulfo group, hydroxy group, aryloxycarbonylamino group, alkoxycarbonylamino group, acylamino group, ureido group, arylthio group, alkylthio group, cyano group. When R is an alkyl group, the alkyl group may be substituted or unsubstituted or straight or branched chain or cyclic. The total number of carbons in R is 0 to 25. The alkyl group may in turn be substituted by the same groups listed for R. The R group may also contain from 1 to 5 thioether moieties in each of which the sulfur atom is directly bonded to a saturated carbon atom. When the R group is an aryl group, the aryl group may be substituted by the same groups listed for R. When R is a heterocyclic group, the heterocyclic group is a 5- or 6-membered monocyclic or condensed ring containing as a heteroatom a nitrogen atom, oxygen atom, or a sulfur atom. Examples are a pyridyl group, a quinolyl group, a furyl group, a benzothiazolyl group, an oxazolyl group, an imidazolyl group, a thiazolyl group, a triazolyl group, a benzotriazolyl group, an imido group and an oxazine group. When there is one or more R groups on a molecule R may be the same of different and s is 1 to 4.

Further preferred INH groups are selected from the following the structures:

INH-1

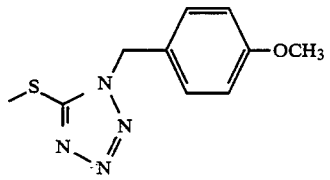

INH-2

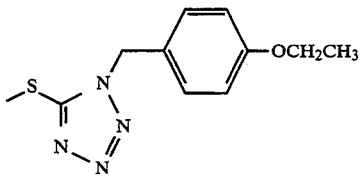

INH-3

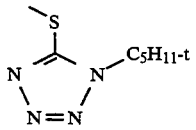

INH-4

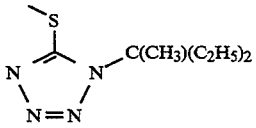

INH-5

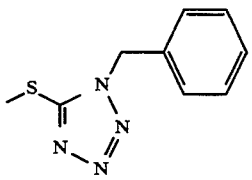

-continued

INH-6

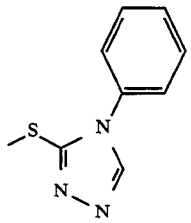

INH-7

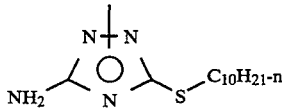

INH-8

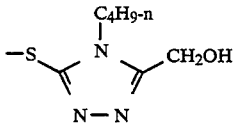

INH-9

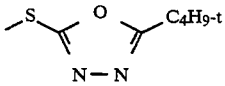

INH 10

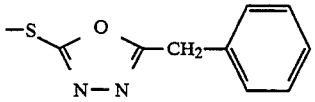

INH 11

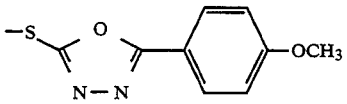

INH 12

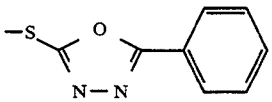

INH 13

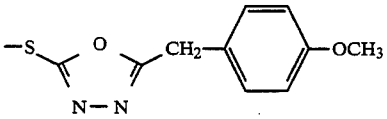

INH-14

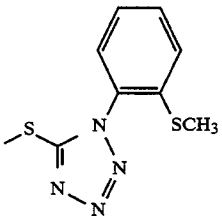

INH-15

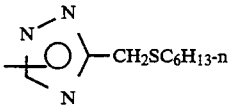

INH-16

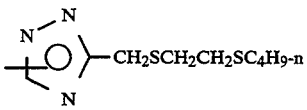

-continued

INH-17

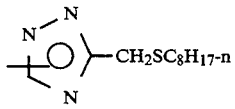

INH-18

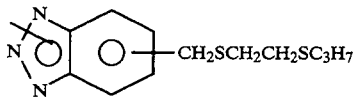

INH-19

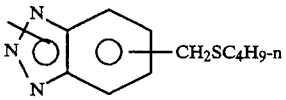

INH-20

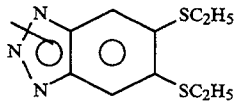

INH-21

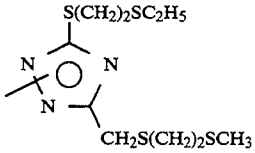

INH-22

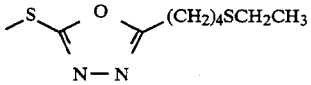

Preferably CAR is a coupler moiety and further the coupler moiety may be ballasted.

In the element in accordance with the invention the -(TIME)$_n$-INH group is bonded to a coupling position of the coupler moiety.

Preferably CAR is unballasted and at least one TIME moiety attached to CAR is ballasted and CAR is preferably a coupler moiety.

Further, preferably CAR is a moiety which can cross-oxidize with oxidized color developer, and may be selected from the class consisting of hydrazides and hydroquinones.

The compound (I) may be present in the element from 0.5 to about 30 mg/ft$^2$ (0.005 to 0.3 g/m$^2$) and typically is present in the element from about 1 to about 10 mg/ft$^2$ (0.01 to 0.1 g/m$^2$).

CAR can, for example, be a coupler residue, designated COUP, which forms a dye as a part of a coupling reaction, or an organic residue which forms no dye. The purpose of CAR is to furnish, as a function of color development, a fragment INH, or iNH linked to a linking group or timing group or to a combination of linking and timing groups, designated -(TIME)$_n$-. So long as it performs that function in an efficient manner, it has accomplished its purpose for this invention. It will be noted that when a highly active CAR is used the INH strength can be less than 1 (one) because the reactivity of the active CAR is sufficient to release the INH at an early time of development to provide interimage and sharpness effects of the invention.

When COUP is a yellow coupler residue, coupler residues having general formulas II–IV are preferred. When COUP is a magenta coupler residue, it is preferred that COUP have formula (V) or (VIII). When COUP is a cyan coupler residue, it is preferred that COUP have the formula represented by general formulas (VI) and (VII).

Furthermore, CAR may be a redox residue, which is a group capable of being cross oxidized with an oxidation product of a developing agent. Such carriers may be hydroquinones, catechols, pyrogallols, aminonaphthols, aminophenols, naphthohydroquinones, sulfonamidophenols, hydrazides, and the like. Compounds with carriers of these types are disclosed in U.S. Pat. No. 4,791,049. Preferred CAR fragments of this type are represented by general formulas (X) and (XI). The amino groups included therein are preferably substituted with $R_{10}$ which is a sulfonyl group having one to 25 carbon atoms, or an acyl group having 1–25 carbon atoms; the alkyl moieties in these groups can be substituted. Compounds within formulas (IX) and (XII) are compounds that react with oxidized developer to form a colorless product or a dye which decolorizes by further reaction.

So long as the color reversal film has an image modifying compound of the type described herein, in one image forming layer, the film is as described for this invention. It is to be understood, however, that the film may have two or more described image modifying compounds in an image forming silver halide emulsion layer, or that two or more such layers may have one or more described image modifying compounds.

In general compound (I) is represented by, for example, the following structures:

II

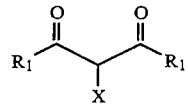

III

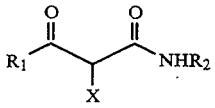

IV

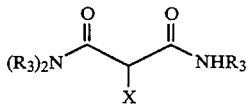

V

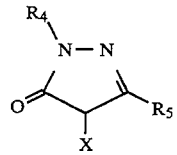

VI

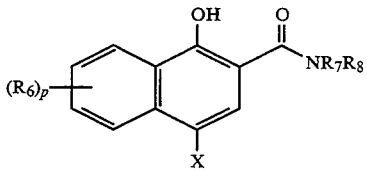

VII

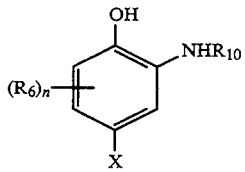

-continued

VIII

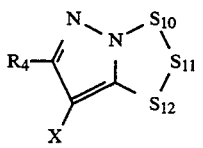

IX

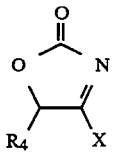

X

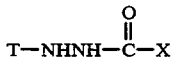

XI

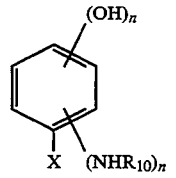

XII

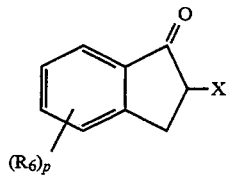

In the foregoing compounds, X=-(TIME)$_n$-INH, and $R_1$ represents an aliphatic group, an aromatic group, an alkoxy group, or a heterocyclic ring, and $R_2$ and $R_3$ are each an aromatic group, an aliphatic group or a heterocyclic ring. The aliphatic group represented by $R_1$ preferably contains from 1 to 30 carbon atoms, and may be substituted or unsubstituted, straight or branched chain, or cyclic. Preferred substituents for an alkyl group include an alkoxy group, an aryloxy group, an amino group, an acylamino group, and a halogen atom. These substituents per se may be substituted. Suitable examples of aliphatic groups represented by $R_1$, $R_2$ and $R_3$ are as follows: an isopropyl group, an isobutyl group a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)-isopropyl group, and an α-(benzenesulfonamido)isopropyl group. When two $R_1$ or $R_3$ groups appear, they may be alike or different.

When $R_1$, $R_2$ or $R_3$ represents an aromatic group (particularly a phenyl group), the aromatic group may be substituted or unsubstituted. That is, the phenyl group can be employed per se or may be substituted by a group containing 32 or less carbon atoms, e.g., an alkyl group, an alkenyl group, an alkoxy group, an alkoxycarbonyl group, an alkoxycarbonylamino group, an aliphatic amido group, an alkylsulfamoyl group, an alkylsulfonamido group, an acylureido group, and an alkyl-substituted succinimido group. This alkyl group may contain an aromatic group, e.g., phenylene, in the chain thereof. The phenyl group may also be substituted by, e.g., an aryloxy group, an aryloxycarbonyl group, an arylcarbamoyl group, an arylamido group, an arylsulfamoyl group, an arylsulfonamido group, or an arylureido group. In these subtituents, the aryl group portion may be further substituted by at least one alkyl group containing from 1 to 22 carbon atoms in total.

The phenyl group represented by $R_1$, $R_2$, or $R_3$ may be substituted by an amino group which may be further substituted by a lower alkyl group containing from 1 to 6 carbon atoms, a hydroxyl group, a carboxyl group, a sulfo group, a nitro group, a cyano group, a thiocyano group, or a halogen atom.

In addition, $R_1$, $R_2$ or $R_3$ may further represent a substituent resulting from condensation of a phenyl group with another ring, e.g., a naphthyl group, a quinolyl group, an isoquinolyl group, a furanyl group, a cumaranyl group, and a tetrahydronaphthyl group. These substituents per se may be further substituted.

When $R_1$ represents an alkoxy group, the alkyl portion of the alkoxy group contains from 1 to 40 carbon atoms and preferably from 1 to 22 carbon atoms, and is a straight or branched alkyl group, a straight or branched alkenyl group, a cyclic alkyl group, or a cyclic alkenyl group. These groups may be substituted by, e.g., a halogen atom, an aryl group or an alkoxy group.

When $R_1$, $R_2$ or $R_3$ represents a heterocyclic ring, the heterocyclic ring is bound through one of the carbon atoms in the ring to the carbon atom of the carbonyl group of the acyl group in α-acylacetamide, or to the nitrogen atom of the amido group in α-acylacetamide. Examples of such heterocyclic rings are thiophene, furan, pyran, pyrrole, pyrazole, pyridine, piperidine, pyrimidine, pyridazine, indolizine, imidazole, thiazole, oxazole, triazine, thiazine and oxazine. These heterocyclic rings may have a substituent on the ring thereof.

In structure (V), $R_4$ contains from 1 to 40 carbon atoms, preferably from 1 to 30 carbon atoms, and is a straight or branched alkyl group (e.g., methyl, isopropyl, tert-butyl, hexyl and dodecyl), an alkenyl group (e.g., an allyl group), a cyclic alkyl group (e.g., a cyclopentyl group, a cyclohexyl group and a norbornyl group), an aralkyl group (e g., a benzyl group and a β-phenylethyl group), or a cyclic alkenyl group (e.g., a cyclopentenyl group and a cyclohexenyl group). These groups may be substituted by, e.g., a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group and a mercapto group.

$R_4$ may further represent an aryl group, e.g. a phenyl group, and an α- or β-naphthyl group. This aryl group contains at least one substituent. These substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxyl group and a mercapto group.

More preferably, $R_4$, is a phenyl group which is substituted by,,e.g., an alkyl group, an alkoxy group or a halogen atom, in at least one of the ortho positions.

$R_4$ may further represent a heterocyclic ring (e.g., 5- or 6-membered heterocyclic or condensed heterocyclic group containing a nitrogen atom, an oxygen atom or a sulfur atom as a hetero atom, such as a pyridyl group, a quinolyl group, a furyl group, a benzothiazolyl group, an oxazolyl group, an imidazolyl group and a naphthoxazolyl group), a heterocyclic ring substituted by the groups described for the aryl group as described above, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

$R_5$ is a hydrogen atom, a straight or branched alkyl group containing from 1 to 40 carbon atoms, preferably from 1 to 30 carbon atoms, an alkenyl group, a cyclic alkyl group, an aralkyl group, a cyclic alkenyl group to which may contain substituents as described for $R_4$), an aryl group and a heterocyclic group (which may contain substituents as described for $R_4$,), an alkoxycarbonyl group (e.g., a methoxycarbonyl group, an ethoxycarbonyl group and a stearyloxycarbonyl group), an aryloxycarbonyl group (e.g., a phenoxycarbonyl group, and a naphthoxycarbonyl group), an aralkyloxycarbonyl group (e.g., a benzyloxycarbonyl group), an alkoxy group (e.g., a methoxy group, an ethoxy group and a heptadecyloxy group), an aryloxy group (e.g., a phenoxy group and a tolyloxy group), an alkylthio group (e.g., an ethylthio group, and a dodecylthio group), an arylthio group (e.g., a phenylthio group and an α-naphthylthio group), a carboxyl group, an acylamino group (e.g., an acetylamino group and a 3-[(2,4-di-tert-amylphenoxy)acetamido]benzamido group), a diacylamino group, an N-alkylacylamino group (e.g., an N-methylproprionamido group), an N-arylacylamino group (e.g., an N-phenylacetamido group), a ureido group (e.g. a ureido group and an N-arylureido group), a urethane group, a thiourethane group, an arylamino group (e.g., a phenylamino group, an N-methylanilino group, a diphenylamino group, an N-acetylanilino group and a 2-chloro-5-tetradecanamidoanilino group), a dialkylamino group (e.g., a dibenzylamino group), an alkylamino group (e.g., an n-butylamino group, a methylamino group and a cyclohexylamino group), a cycloamino group (e.g., a piperidino group and a pyrrolidino group), a heterocyclic amino group (e.g., a 4-piperidylamino group and a 2-benzoxazolylamino group), an alkylcarbonyl group (e.g., a methylcarbonyl group), an arylcarbonyl group (e.g., a phenylcarbonyl group), a sulfonamido group (e.g., an alkylsulfonamido group, and an arylsulfonamido group), a carbamoyl group (e.g., an ethylcarbamoyl group, a dimethylcarbamoyl group, an N-methylphenylcarbamoyl group, and an N-phenylcarbamoyl group), a 4,4'-sulfonyldiphenoxy group, a sulfamoyl group (e.g., an N-alkylsulfamoyl group, an N,N-dialkylsulfamoyl group, an N-arylsulfamoyl group, an N-alkyl-N-arylsulfamoyl group and an N,N-diarylsulfamoyl group), a cyano group, a hydroxyl group, a mercapto group, a halogen atom or a sulfo group.

$R_6$, $R_7$ and $R_8$ each represents groups as used for the usual 4-equivalent type phenol or α-naphthol couplers. In greater detail, $R_6$ is a hydrogen atom, a halogen atom, an aliphatic hydrocarbon residue, an acylamino group, —O—$R_9$ or —S—$R_9$ (wherein $R_9$ is an aliphatic hydrocarbon residue). When there are two or more $R_6$ groups in the same molecule, they may be different. The aliphatic hydrocarbon residue includes those containing a substituent(s). $R_7$ and $R_8$ are each an aliphatic hydrocarbon residue, an aryl group or a heterocyclic residue. One of $R_7$ and $R_8$ may be a hydrogen atom, and the above-described groups for $R_7$ and $R_8$ may be substituted. $R_7$ and $R_8$ may combine together to form a nitrogen-containing heterocyclic nucleus. In the formulas, n is an integer of from 1 to 3, and p is an integer of from 1 to 5.

$R_{11}$ group refers to a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a hydroxy group, or an alkanosulfonyl group. The alkyl group on $R_{11}$ contains 1 to 32 carbons. In the general formulae XXXII, Z is oxygen, nitrogen, or sulfur, and k is an integer of 0 to 2.

$R_{10}$ is an acylamido group represented by $COR_1$, a carbamoyl group represented by $CONHR_7RS_8$, a sulfonamido group represented by $SO_2R_1$, or a $SO_2NR_7R_8$.

The aliphatic hydrocarbon residue may be saturated or unsaturated, straight, branched or cyclic. Preferred examples are an alkyl group (e.g., a methyl group, an ethyl group, a propyl group, an isopropyl group, a butyl group, a tert-butyl group, an isobutyl group, a dodecyl group, an octadecyl group, a cyclobutyl group, and a cyclohexyl group), and an alkenyl group (e.g., an allyl group, and an octenyl group).

The aryl group includes a phenyl group and a naphthyl group, and typical examples of heterocyclic residues are a pyridinyl group, a quinolyl group, a thienyl group, a piperidyl group and an imidazolyl group. Substituents which may be introduced to these aliphatic hydrocarbon, aryl, and heterocyclic groups include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group and a morpholino group.

In compounds (II) to (XXII), the substituents, $R_1$, $R_2$, $R_3$, $R_4$, $R_5$, $R_6$, $R_7$ and $R_8$ may combine together to form symmetrical or asymmetrical composite couplers, or any of the substituents may become a divalent group to form symmetrical or asymmetrical composite couplers.

In compounds VIII: $S_{10}$, $S_{11}$ and $S_{12}$ each represents a methine, a substituted methine, =N—, or —NH—; one of $S_{10}$–$S_{11}$ bond and $S_{11}$–$S_{12}$ bond is a double bond and the other is a single bond; when $S_{11}$–$S_{12}$ is a carbon-carbon double bond, the double bond may be a part of an aromatic ring; the compound of general formula VIII includes the case that it forms a dimer or higher polymer at $R_4$; and also when $S_{10}$, $S_{11}$ or $S_{12}$ is a substituted methine, the compound includes the case that it forms a dimer or higher polymer with the substituted methine. Polymer formation can also take place through the linking group -(TIME)$_n$- in all image modifying compounds employed in this invention.

If $R_1$ through $R_{10}$ of structures II through VIII are a ballast such that the dye which is formed on reaction with oxidized developer remains in the film after processing then the formulae are represented by Type II examples.

Especially preferred are those couplers which undergo a coupling reaction with an oxidation product of a developing agent, releasing a development inhibitor, but do not leave a dye in the film which could cause degradation of the color quality. If $R_1$ through $R_{10}$ of compounds II through VIII are not a ballast such that the subsequent dye formed from CAR is not immobilized, and is removed from the film during processing, then the formulae are represented by Type I examples. Also included in these Type I examples are formulae IX, X, XI and XII in which $R_1$ through $R_8$ do represent a ballast, but CAR either forms a colorless product or doesn't form a dye on reaction with oxidized developer (as in the case with compounds XI and XII) or the dye that is formed is decolorized by subsequent reactions in the process (as is the case with compounds IX and XII).

Also preferred structures which would produce the same effects as DIR couplers without leaving a retained dye in the film are those in which CAR is a material capable of undergoing a redox reaction with the oxidized product of a developing agent and subsequently releasing a development inhibitor as described in U.S. Pat. No. 4,684,604 and represented by the compound X where T represents a substituted aryl group. T may be represented by phenyl, naphthyl; and heterocyclic aryl rings (e.g. pyridyl) and may be substituted by one or more groups such as alkoxy, alkyl, aryl, halogen, and those groups described as $R_5$.

$R_{10}$ is selected from alkyl or aryl sulfonyl groups and alkyl and aryl carbonyl groups.

In the compounds (I), -(TIME)$_n$-INH is a group which is not released until after reaction with the oxidized developing agent either through cross oxidization or dye formation.

-(TIME)$_n$- in the compounds (I) is one or more linking or timing groups connected to CAR through a oxygen atom, a nitrogen atom, or a sulfur atom which is capable of releasing INH from -(TIME)$_n$-INH at the time of development through one or more reaction stages. Suitable examples of these types of groups are found in U.S. Pat. Nos. 4,248,962, 4,409,323, 4,146,396, British Pat. No. 2,096,783, Japanese Patent Application (Opi) Nos. 146828/76 and 56837/82, etc.

Preferred examples of -(TIME)- are those represented by the following examples XIII–XX:

XIII

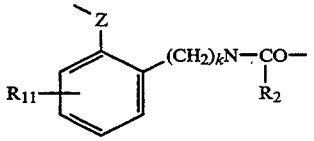

-continued

XIV

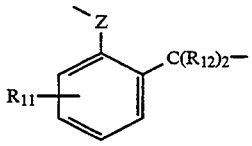

XV

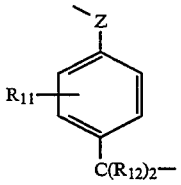

XVI

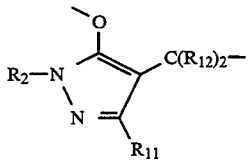

XVII

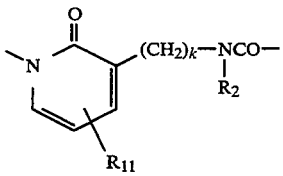

XVIII

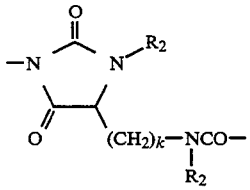

XIX

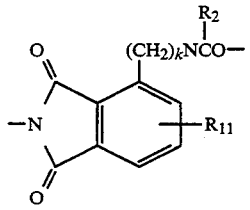

XX

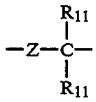

In each of the foregoing compounds, the bond on the left is attached to either CAR or another -(TIME)- moiety, and the bond to the right is attached to INH.

$R_{12}$ is hydrogen, alkyl, perfluoroalkyl, alkoxy, alkylthio, aryl, aryloxy, arylthio, $(R_2)_2N$—, $R_1CONR_7$—, or heterocyclic; $(R_{12})_2$ can complete a non-aromatic heterocyclic or a non-aromatic carbocyclic ring, and $R_{12}$ and $R_{11}$ can complete a non-aromatic heterocyclic or non-aromatic carbocyclic ring.

In timing groups XIII, XIV, XV, and XVII, $R_{11}$ can complete a carbocyclic or heterocyclic ring or ring system. Rings completed include derivatives of naphthalene, quinoline, and the like.

When n=0, -(TIME)$_n$- also represents a single bond such that CAR may be directly joined to INH.

For n=2, there can be a combination of any two timing groups mentioned in formulas XIII to XX which still allows the fragmentation and release of INH during color development after CAR has reacted with the oxidized developer. The combination of two timing groups may be used to improve the release of the inhibitor fragment INH either through rate of release and/or diffusability of -(TIME)$_n$-INH or any of its subsequent fragments. For example, preferred structures are:

XXI

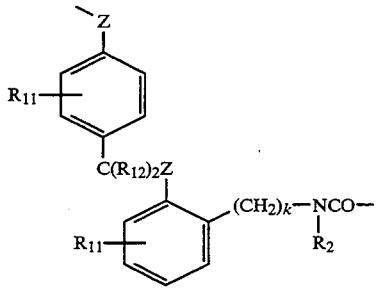

XXII

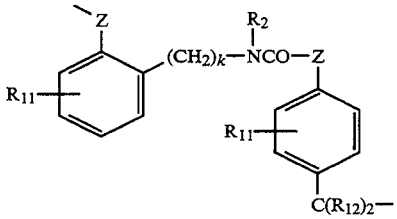

XXIII

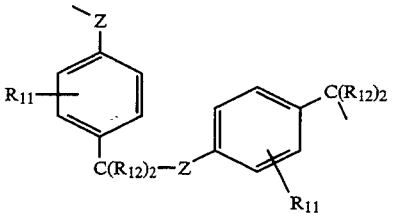

XXIV

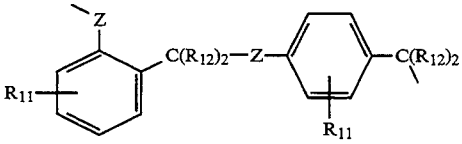

-continued

XV

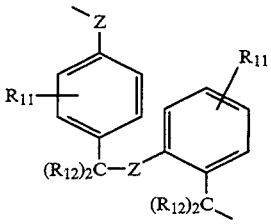

XXVI

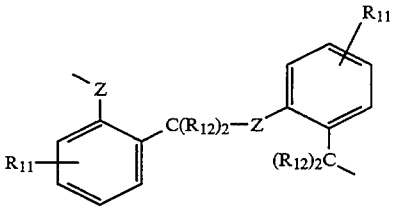

Naphtholic DIR couplers as described can be prepared by reactions and methods known in the organic compound synthesis art. Similar reactions and methods are described in U.S. Pat. No. 4,482,629. Methods of synthesising naphtholic couplers are also described in U.S. Patent Application for "Image Formation In Color Reversal Materials Using Strong Inhibitors", Attorney Docket No. 66553, by Burns et al. filed on the same date as the present application, and any of the DIRs of that invention can be used in the present invention. The foregoing application is incorporated by reference in the present application. It should also be noted that the photographic elements of the present invention may be the same as the elements of that application but with the addition of at least one absorber dye, as described herein. For this invention, the image modifying compound of the type described above is present in a silver halide layer which contributes to image formation by substantial formation of a dye. It is preferred that the image modifying compound be present in an amount of from about 0.5 to about 30 mg/ft$^2$ (0.0054 to 0.323 g/m$^2$ of the reversal color material, e.g. film; more preferably, from 1 to about 10 mg/ft$^2$ (0.01 to 0.108 g/m$^2$) .

Illustrative but not limiting image modifying compounds which can be employed in this invention appear below:

DIR-1

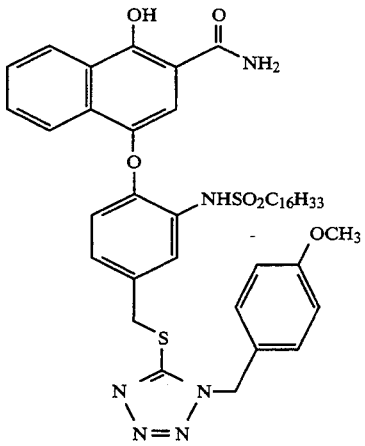

DIR-2

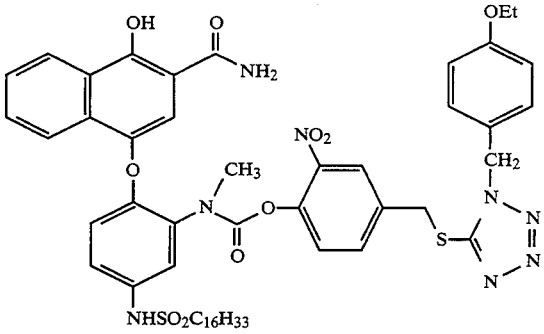

-continued
DIR-3
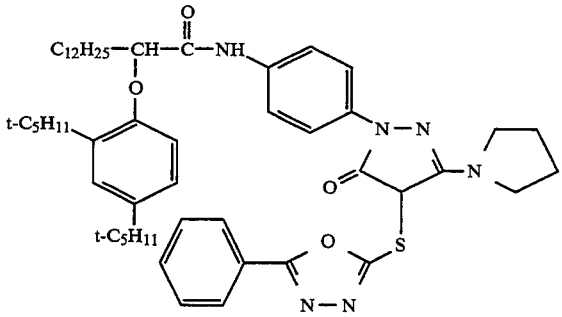
DIR-4
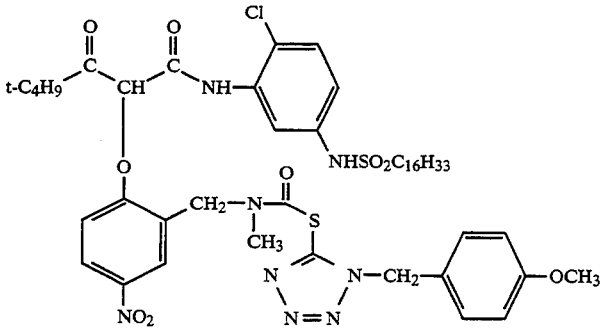
DIR-5
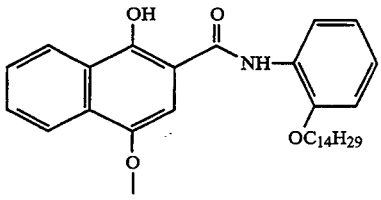
DIR-6
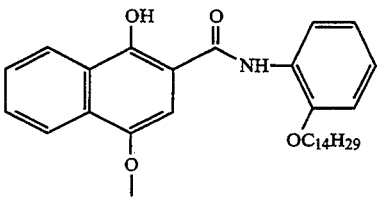
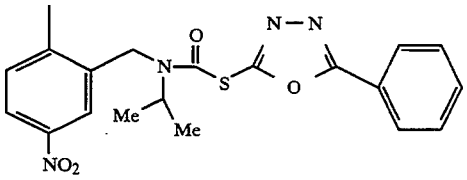
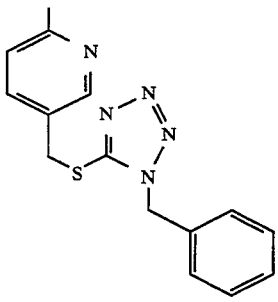
DIR-7
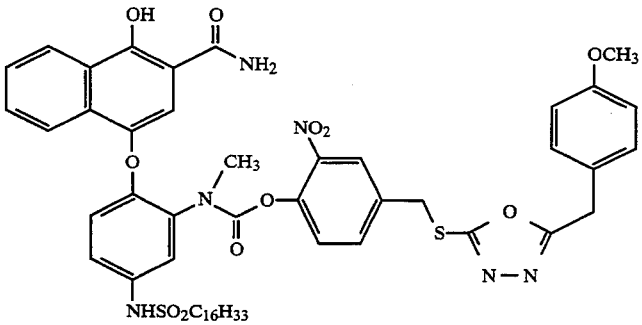

-continued
DIR-8
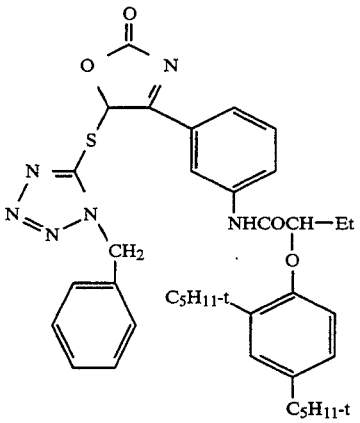
DIR-9
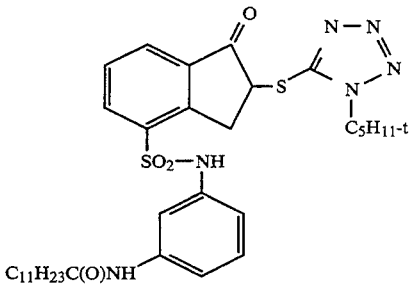
DIR-10
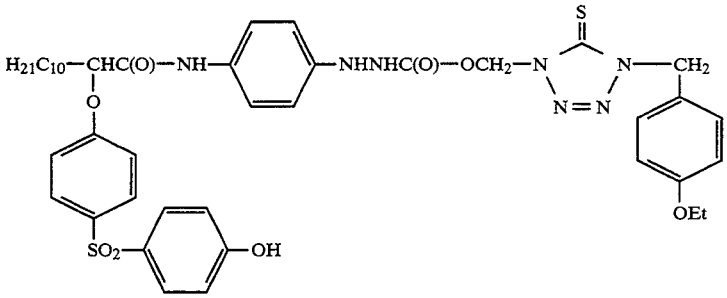
DIR-11
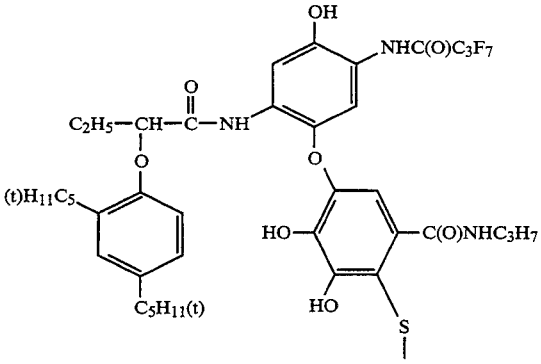
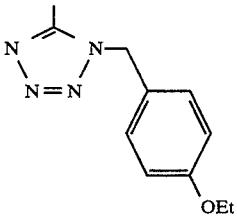

-continued
DIR-12
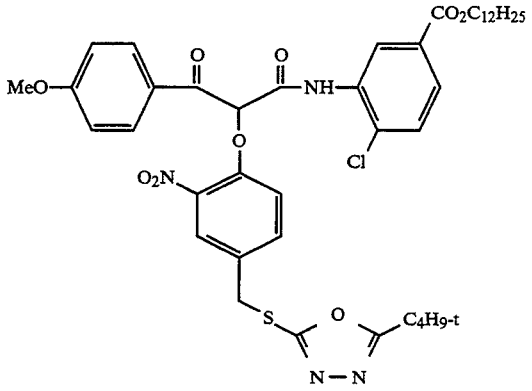
DIR-13
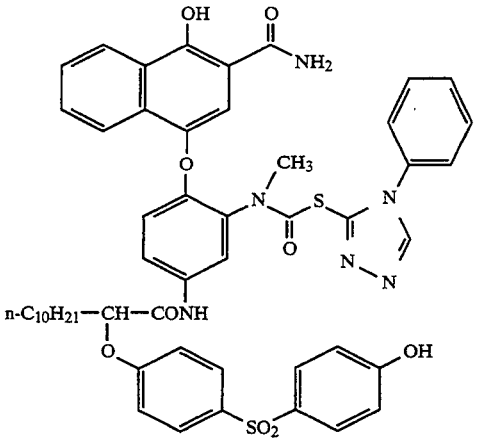
DIR-14
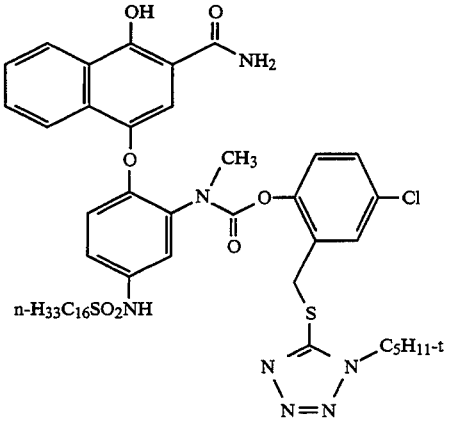
DIR-15
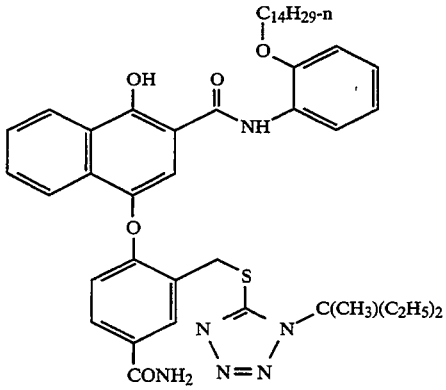
DIR-16
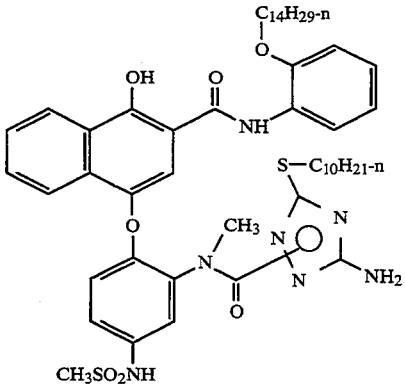
DIR-17
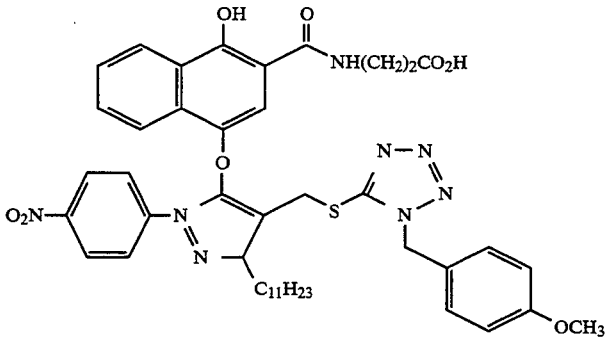

-continued
DIR-18
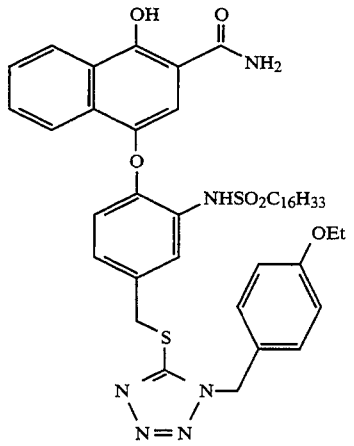
DIR-19
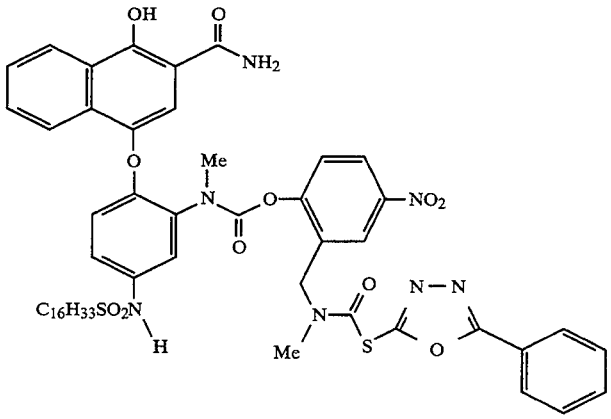
DIR-20
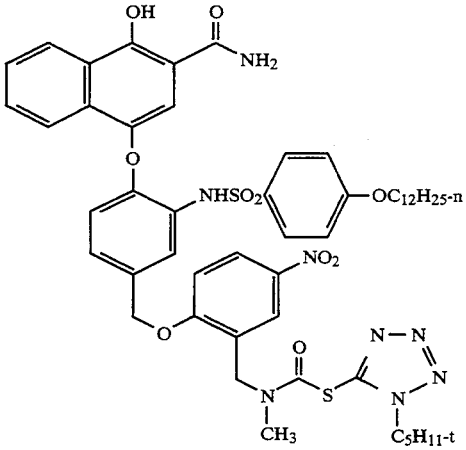
DIR-21
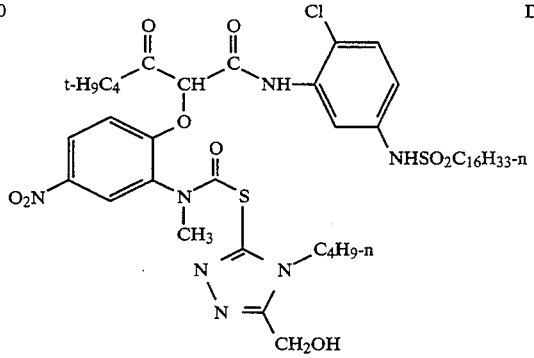
DIR-22
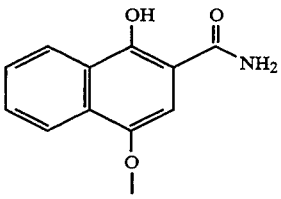

-continued
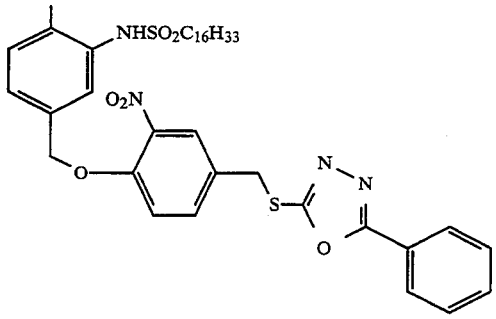
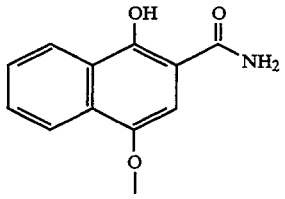
DIR-23
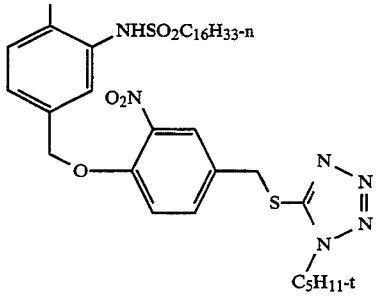
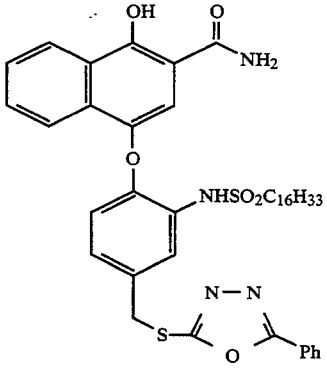
DIR-24
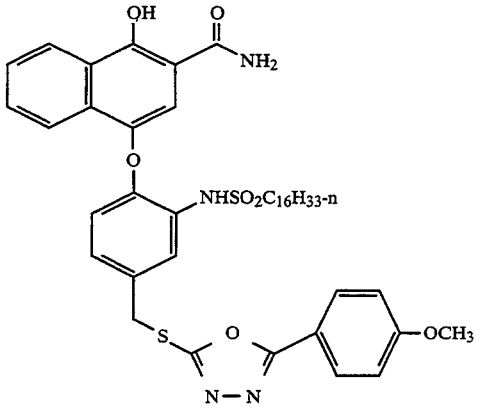
DIR-25
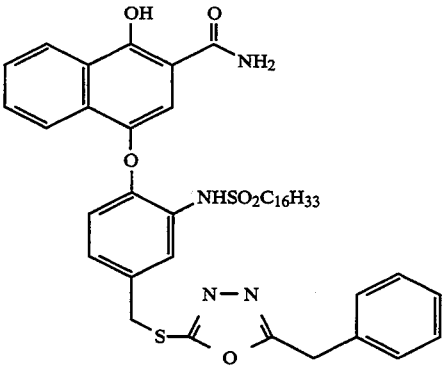
DIR-26
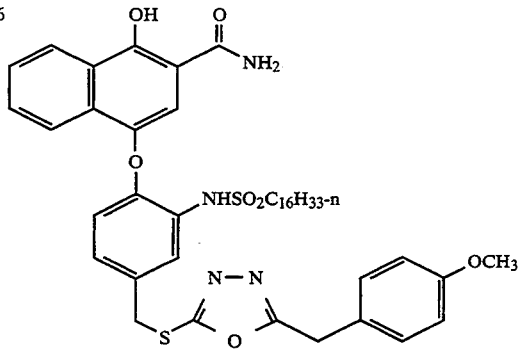
DIR-27

-continued
DIR-28
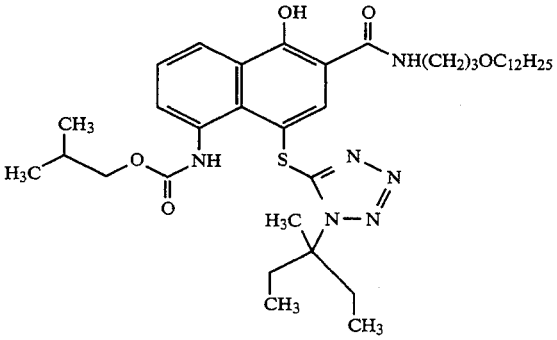
DIR-29
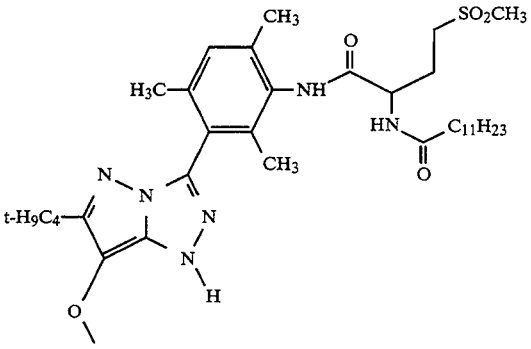
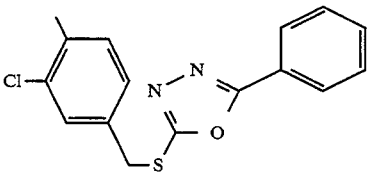
DIR-30
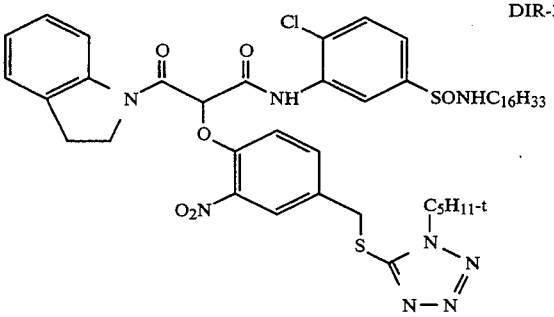
DIR-31
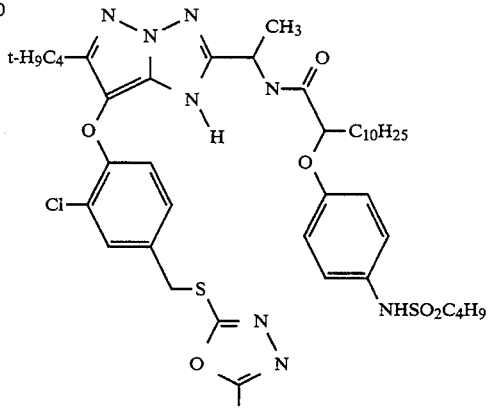

-continued
DIR-32
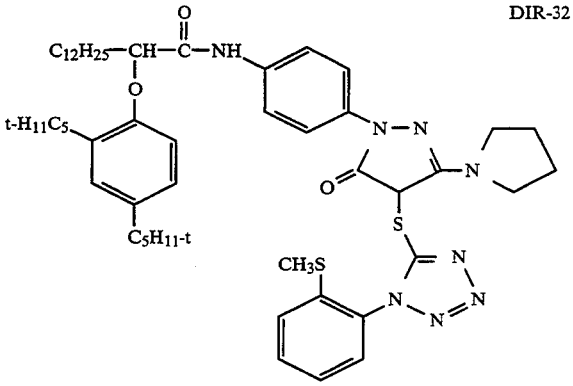
DIR-33
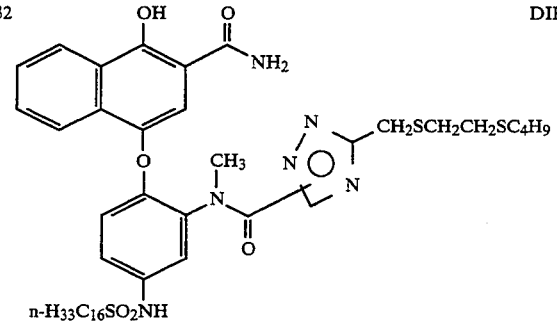
DIR-34
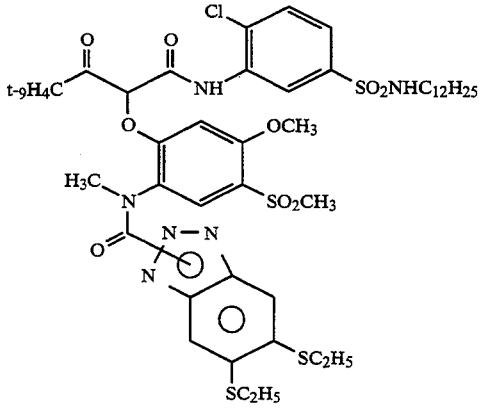
DIR-35
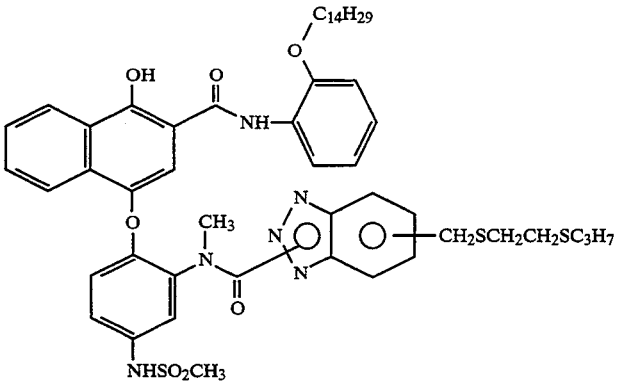
DIR-36
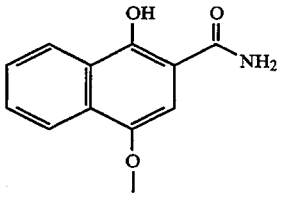

-continued

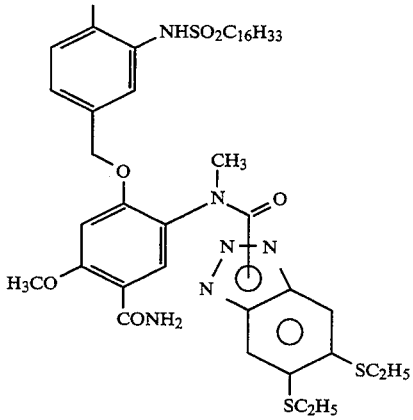

DIR-37

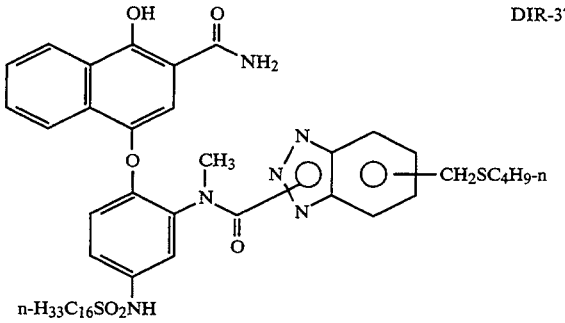

DIR-38

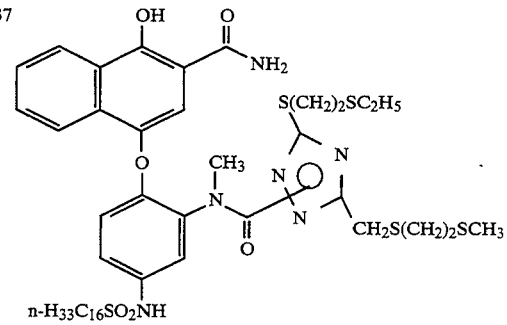

DIR-39

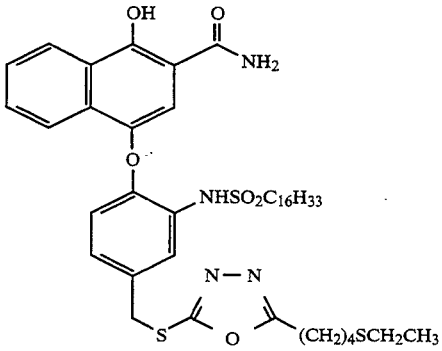

DIR-40

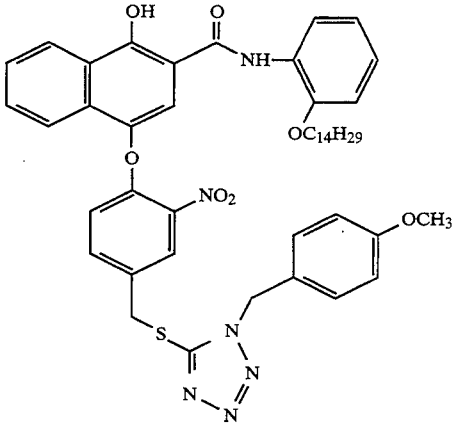

DIR-41

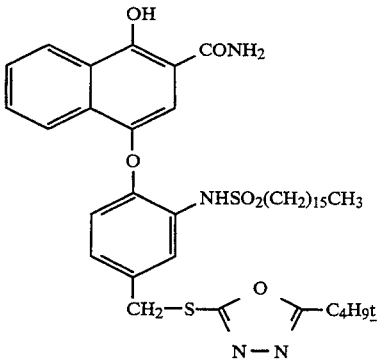

In order to incorporate the compounds according to the present invention and couplers to be used together into a silver halide emulsion layer known methods, including those described, e.g., in U.S. Pat. No. 2,322,027 can be used. For example, they can be dissolved in a solvent and then dispersed in a hydrophilic colloid. Examples of solvents usable for this process include organic solvents having a high boiling point, such as alkyl esters of phthalic acid (e.g., dibutyl phthalate, dioctyl phthalate, etc.), phosphoric acid esters (e.g., diphenyl phosphate, triphenyl phosphate, tricresyl phosphate, dioctyl butyl phosphate, etc.) citric acid esters (e.g., tributyl acetyl citrate, etc.) benzoic acid esters (e.g., octyl benzoate, etc.), alkylamides (e.g., diethyl laurylamides, etc.), esters of fatty acids (e.g. dibutoxyethyl succinate, dioctyl azelate, etc.), trimesic acid esters (e.g., tributyl trimesate, etc.), or the like; and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, b-ethoxyethyl acetate, methyl cellosolve acetate, or the like. Mixtures of organic solvents having a high boiling point and organic solvents having a low boiling point can also be used.

It is also possible to utilize the dispersing method using polymers, as described in Japanese Patent Publication No. 39853/76 and Japanese Patent Application (OPI) No. 59943/76.

Of the couplers, those having an acid group, such as a carboxylic acid group or a sulfonic acid group, can be introduced into hydrophilic colloids as an aqueous alkaline solution.

As the binder or the protective colloid for the photographic emulsion layers or intermediate layers of the photographic light-sensitive material of the present invention, gelatin is advantageously used, but other hydrophilic colloids can be used alone or together with gelatin.

As gelatin in the present invention, not only lime-processed gelatin, but also acid-processed gelatin may be employed. The methods for preparation of gelatin are described in greater detail in Ather Veis, *The Macromolecular Chemistry of Gelatin*, Academic Press (1964).

As the above-describedhydrophilic colloids other than gelatin, it is possible to use proteins such as gelatin derivatives, graft polymers of gelatin and other polymers, albumin, casein, etc.; saccharides such as cellulose derivatives such as hydroxyethyl cellulose, cellulose sulfate, etc., sodium alginate, starch derivatives, etc.; and various synthetic hydrophilic high molecular weight substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinyl imidazole, polyvinylpyrazole, etc.

In the photographic emulsion layer of the photographic light-sensitive material used in the present invention, any of silver bromide, silver iodobromide, silver iodochlorobromide, silver chlorobromide and silver chloride may be used as the silver halide. A preferred silver halide is silver iodobromide containing 15 mol % or less of silver iodide. A silver iodobromide emulsion containing from 2 mol % to 12 mol % of silver iodide is particularly preferred.

Although the mean grain size of silver halide particles in the photographic emulsion (the mean grain size being determined with a grain diameter in those particles which are spherical or nearly spherical, and an edge length in those particles which are cubic as a grain size, and is expressed as a mean value calculated from projected areas) is not particularly limited, it is preferably 6 μm or less.

The distribution of grain size may be broad or narrow.

Silver halide particles in the photographic emulsion may have a regular crystal structure, e.g., a cubic or octahedral structure, an irregular crystal structure, e.g., a spherical or plate-like structure, or a composite structure thereof. In addition, silver halide particles composed of those having different crystal structures may be used.

Further, the photographic emulsion wherein at least 50 percent of the total projected area of silver halide particles in tabular silver halide particles having a diameter at least five times their thickness may be employed.

The inner portion and the surface layer of silver halide particles may be different in phase. Silver halide particles may be those in which a latent image is formed mainly on the surface thereof, or those in which a latent image is formed mainly in the interior thereof.

The photographic emulsion used in the present invention can be prepared in any suitable manner, e.g., by the methods as described in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964). That is, any of an acid process, a neutral process, an ammonia process, etc., can be employed.

Soluble silver salts and soluble halogen salts can be reacted by techniques such as a single jet process, a double-jet process, and a combination thereof. In addition, there can be employed a method (so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or its complex salts, the rhodium salts or its complex salts, iron salts or its complex salts, and the like.

For removal of soluble salts from the emulsion after precipitate formation or physical ripening, a well known noodle washing process in which gelatin is gelated may be used. In addition, a flocculation process utilizing inorganic salts having a polyvalent anion (e.g., sodium sulfate), anionic surface active agents, anionic polymers (e.g., polystyrenesulfonic acid), or gelatin derivatives (e.g., aliphatic acylated gelatin, aromatic acrylated gelatin and aromatic carbamoylated gelatin) may be used.

Silver halide emulsions are usually chemically sensitized. For this chemical sensitization, for example, the methods as described in H. Frieser ed., *Die Grundlagen Der Photographischen Prozesse mir Silberhalogeniden, Akademische Verlagsgesellschaft*, pages 675 to 734 (1968) can be used. Namely, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid and silane compounds); a noble metal sensitization process using noble metal compounds (e.g., complex salts of Group VIII metals in the Periodic Table, such as Pt, Ir and Pd, etc., as well as gold complex salts); and so forth can be applied alone or in combination with each other.

The photographic emulsion used in the present invention may include various compounds for the purpose of preventing fog formation or of stabilizing photographic performance in the photographic light sensitive material during the production, storage or photographic processing thereof. For example, those compounds known as antifoggants or stabilizers can be incorporated, including azoles such as benzothiazolium salts; nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particular 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxysubstituted (1,3,3a,7)tetraazaindenes), pentaazaindenes, etc.; benzenethiosulfonic acids; benzenesulfinic acids; benzenesulfonic amides, etc.

In the photographic emulsion layers or other hydrophilic colloid layers of the photographic lightsensitive material of the present invention can be incorporated various surface active agents as coating aids or for other various purposes, e.g., prevention of charging, improvement of slipping properties, acceleration of emulsification and dispersion, prevention of adhesion and improvement of photographic characteristics (for example, development acceleration, high contrast, and sensitization), etc.

Surface active agents which can be used are nonionic surface active agents, e.g., saponin (steroid-based), alkyene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or polyalkylene glycol alkylamides, and silicone/polyethylene oxide adducts, etc.), glycidol derivatives (e.g., alkenylsuccinic acid polyglyceride and alkylphenol polyglyceride, etc.), fatty acid esters of polyhydric alcohols and alkyl esters of sugar, etc.; anionic surface active agents containing an acidic group, such as a carboxy group, a sulfo group, a phospho group, a sulfuric acid esters group, and a phosphoric acid ester group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters, amphoteric surface active agents, such as amino acids, aminoalkylsulfonic acids, aminoalkylsulfuric acid or aminoalkylphosphoric acid esters, alkylbetaines, and amine oxides; and cationic surface active agents, e.g., alkylamine salts, aliphatic or aromatic quaternary ammonium salts, heterocyclic quaternary ammonium salts (e.g., pyridinium and imidazolium) and aliphatic or hetercyclic phosphonium or sulfonium salts.

The photographic emulsion layer of the photographic light-sensitive material of the present invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development.

In the photographic emulsion layer or other hydrophilic colloid layers of the photographic lightsensitive material of the present invention can be incorporated water-insoluble or sparingly soluble synthetic polymer dispersions for the purpose of improving dimensional stability, etc. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, etc. and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid, etc.

In photographic processing of layers composed of photographic emulsions in the photographic light sensitive material of the present invention, any of known procedures and known processing solutions, e.g., those described in *Research Disclosure*, No. 176, pages 28 to 30 can be used. The processing temperature is usually chosen from between 18° C. and 50° C., although it may be lower than 18° C. or higher than 50° C.

Any fixing solutions which have compositions generally used can be used in the present invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

Color developing solutions are usually alkaline aqueous solutions containing color developing agents. As these color developing agents, known primary aromatic amine developing agents, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-$\beta$-methanesulfonamidoethylaniline, 4-amino-3-methyl-N-ethyl-N-$\beta$-methoxyethylaniline, etc., can be used to make exhaustive color reversal developers.

In addition, the compounds as described in L. F. A. Mason, *Photographic Processing Chemistry*, Focal Press, pages 226 to 229 (1966), U.S. Pat. Nos. 2,193,015 and 2,592,364, Japanese Patent Application (OPI) No. 64933/73, etc., may be used.

The color developing solutions can further contain pH buffering agents such as sulfite, carbonates, borates and phosphates of alkali metals, etc. developing inhibitors or anti-fogging agents such as bromides, iodides or organic anti-fogging agents, etc. In addition, if desired, the color developing solution can also contain water softeners; preservatives such as hydroxylamine, etc.; organic solvents such as benzyl alcohol, diethylene glycol, etc.; developing accelerators such as polyethylene glycol, quaternary ammonium salts, amines, etc; dye forming couplers; competing couplers; fogging agents such a sodium borohydride, etc.; auxiliary developing agents; viscosity-imparting agents; acid type chelating agents; anti-oxidizing agents; and the like.

After color developing, the photographic emulsion layer is usually bleached. This bleach processing may be performed simultaneously with a fix processing, or they may be performed independently.

Bleaching agents which can be used include compounds of metals, e.g., iron (III), cobalt (III), chromium (VI), and copper (II) compounds. For example, organic complex salts of iron (III) or cobalt (III), e.g., complex salts of acids (e.g., nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a mono-bath bleachfixing solution.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, homopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing allcyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Patent No, 3,743,510), cadmium salts, azaindene compounds, and the like, can be present.

The present invention is also applicable to a multilayer multicolor photographic material containing layers sensitive to at least two different spectral wavelength ranges on a support. A multilayer color photographic material generally possesses at least one red-sensitive silver halide emulsion layer, at least one green-sensitive silver halide emulsion layer and at least one blue-sensitive silver halide emulsion layer, respectively, on a support. The order of these layers can be varied, if desired. Ordinarily, a cyan forming coupler is present in a red-sensitive emulsion layer, a magenta forming coupler is present in a green-sensitive emulsion layer and yellow forming coupler is present in a blue-sensitive emulsion layer, respectively. However, if desired, a different combination can be employed.

The color reversal films of this invention are typically multilayer materials such as described in U.S. Pat. Nos. 4,082,553, 4,729,943, and 4,912,024; paragraph bridging pages 37–38. The support and other elements are as known in the art, e.g. see U.S. Pat. No. 4,912,024, column 38, line 37, and references cited therein.

EXAMPLE 1

The invention is illustrated by the following example: A method for the determination of "inhibitor strength" is described below:

First, a green sensitive silver bromoiodide gelatin emulsion containing 4.0 mol-percent iodide and having an approximate grain length/thickness ratio of 0.70/0.09 micrometers was mixed with a coupler dispersion comprising Cyan Coupler C-1 dispersed in half its weight of di-n-butylphthalate. The resulting mixture was coated onto a cellulose triacetate support according to the following format:

| | | |
|---|---|---|
| OVERCOAT LAYER: | gelatin | 7.5 g/m2 |
| | bis(vinylsulfonylmethyl)ether hardener (1.9% of total gelatin weight) | |
| EMULSION LAYER: | AgBrI emulsion | 1.08 g/m2 (as silver) |
| | coupler | 2.07 mmoles/m2 |
| | gelatin | 4.04 g/m2 |
| FILM SUPPORT | | |

The resulting photographic element (hereafter referred to as the test coating) was cut into 12 inch×35 mm strips and was imagewise exposed to light through a graduated density test object in a commercial sensitometer (3000K light source, 0–3 step wedge, with a Wratten 99 plus 0.3 ND filter) for 0.01 sec to provide a developable latent image. The exposed strip as then slit lengthwise into two 12 inch×16 mm strips. One strip so prepared was subjected to the photographic process sequence outlined below:

| | |
|---|---|
| First developer | 4 min. |
| Water wash | 2 min. |
| Reversal bath | 2 min. |
| Color developer | 4 min. |
| Conditioner | 2 min. |
| Bleach | 6 min. |
| Fix | 4 min. |
| Water wash | 2 min. |

All solutions of the above process were held at a temperature of 36.9° C. The compositions of the processing solution are as follows:

| First developer: | |
|---|---|
| Amino tris(methylenephosphonic acid), pentasodium salt | 0.56 g |
| Diethylenetriaminepentaacetic acid, pentasodium salt | 2.50 g |
| Potassium sulfite | 29.75 g |
| Sodium bromide | 2.34 g |
| Potassium hydroxide | 4.28 g |
| Potassium iodide | 4.50 mg |

-continued

| | |
|---|---|
| 4-Hydroxymethyl-4-methyl-1-phenyl-3-pyrazolidinone | 1.50 g |
| Potassium carbonate | 14.00 g |
| Sodium bicarbonate | 12.00 g |
| Potassium hydroquinone sulfonate | 23.40 g |
| Acetic acid (glacial) | 0.58 g |
| Water to make 1.0 liter | |
| Reversal bath: | |
| Propionic acid | 11.90 g |
| Stannous chloride (anhydrous) | 1.65 g |
| p-Aminophenol | 0.5 mg |
| Sodium hydroxide | 4.96 g |
| Amino tris(methylenephosphonic acid), | 8.44 g |
| Water to make 1.0 liter | |
| Color Developer: | |
| Amino tris(methylenephosphonic acid), pentasodium salt | 2.67 g |
| Phosphoric acid (75% solution) | 17.40 g |
| Sodium bromide | 0.65 g |
| Potassium iodide | 37.5 mg |
| Potassium hydroxide | 27.72 g |
| Sodium sulfite | 6.08 g |
| Sodium metabisulfite | 0.50 g |
| Citrazinic acid | 0.57 g |
| Methanesulfonamide, N-[2-[(4-amino-3-methylphenyl)ethylamino]ethyl]-sulfate (2:3) | 10.42 g |
| 3,6-dithia-1,8-octanediol | 0.87 g |
| Acetic acid (glacial) | 1.16 g |
| Water to make 1.0 liter | |
| Conditioner: | |
| (Ethylenedinitrillo)tetraacetic acid | 8.00 g |
| Potassium sulfite | 13.10 g |
| Thioglycerol | 0.52 g |
| Water to make 1.0 liter | |
| Bleach: | |
| Potassium nitrate | 25.00 g |
| Ammonium bromide | 64.20 g |
| Ammonium ferric (ethylenediamine) | 124.9 g |
| Hydrobromic acid | 24.58 g |
| (Ethylenedinitrilo)tetraacetic acid | 4.00 g |
| Potassium hydroxide | 1.74 g |
| Water to make 1.0 liter | |
| Fixer: | |
| Ammonium thiosulfate | 95.49 g |
| Ammonium sulfite | 6.76 g |
| (Ethylenedinitrilo)tetraacetic acid | 0.59 g |
| Sodium metabisulfite | 7.12 g |
| Sodium hydroxide | 1.00 g |
| Water to make 1.0 liter | |

After the test coating was subjected to this processing sequence and dried the maximum density was read to status A densitometry using a commercial densitometer. This density is called $D_{max}$ (solution A). The other half of the exposed test coating was processed through the same sequence except that the color developer contained 0.25 mmol of the INH compound in addition to the components listed in the above formula. The maximum density obtained for the test coating processed in this manner is called $D_{max}$ (solution B). The inhibitor number, IN, of the INH compound is defined as:

$$IN = \frac{D_{max}\text{ (solution } A) - D_{max}\text{ (solution } B)}{D_{max}\text{ (solution } A)} \times 100$$

The inhibitor strength, IS, of the INH compound is defined as:

$$IS = \frac{IN_{(test)}}{IN_{(control)}}$$

where $IN_{(test)}$ is the inhibitor number determined by the method described above for any INH compound of interest, and $IN_{(control)}$ is the inhibitor number determined for the test coating when 1-phenyl-5-mercapto-1,2,3,4-tetrazole is the INH compound incorporated into the color developer.

It has been found that compounds having the structural formula $$\text{CAR-(TIME)}_n\text{-INH}$$

wherein INH comprises a compound that has a inhibitor strength greater than 1 provide particularly desirable results when incorporated into color reversal photographic elements.

The following examples further illustrate the use of strong DIRs as used in this invention:

EXAMPLE 1A 1.0 g of DIR-2 was dissolved in 2.0 g of N,N-Diethyl lauramide and 3.0 g of ethyl acetate with gentle heating. This solution was then brought to a temperature of 40° C. and then mixed with a solution containing 3.0 g pig gelatin and 0.3 g of the sodium salt of triisopropylnathphalene sulfonic acid dissolved in 40.7 g. of distilled water. The resulting mixture was then passed through a colloid mill three times to produce a dispersion. This dispersion was then used to prepare a photographic element designated as Sample 101 having the composition set forth below:

In the composition of the layers, the coating amounts are shown as g/m$^2$, except for sensitizing dyes, which are shown as the molar amount per mole of silver halide present in the same layer.

Photographic support: cellulose triacetate subbed with gelatin.

| | |
|---|---|
| First layer: Red sensitive layer | |
| Silver iodobromide emulsion (as silver) (4 mol % iodide) | 1.18 |
| Red sensitizing dyes | $1.42 \times 10^{-3}$ |
| Cyan Coupler C-1 | 1.71 |
| Tritolylphosphate | 0.85 |
| DIR-2 | 0.04 |
| Gelatin | 4.03 |
| Second layer: Intermediate layer | |
| Competitor S-3 | 0.16 |
| Dye-1 | 0.06 |
| Gelatin | 0.86 |
| Third layer: Green sensitive layer | |
| Silver iodobromide emulsion (as silver) (4 mol % iodide) | 1.18 |
| Green sensitizing dyes | $2.0 \times 10^{-3}$ |
| Coupler M-1 | 1.67 |
| Tritolylphosphate | 0.84 |
| Gelatin | 4.03 |
| Fourth layer: Protective layer | |

-continued
| | |
|---|---|
| Gelatin | 3.23 |
| Bis(vinylsulfonylmethane) | 0.23 |
COM INH-1
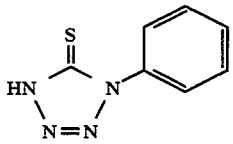
COM INH-2
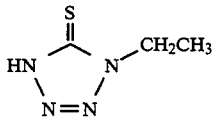
COM INH-3
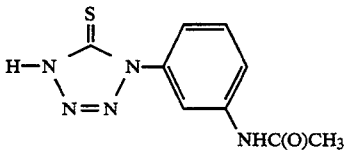
COM INH-4
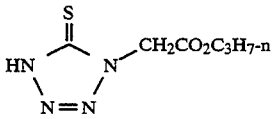
COM INH-5
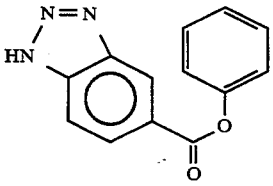
COM DIR-1
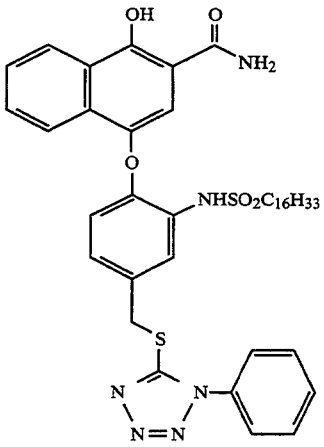
COM DIR-2
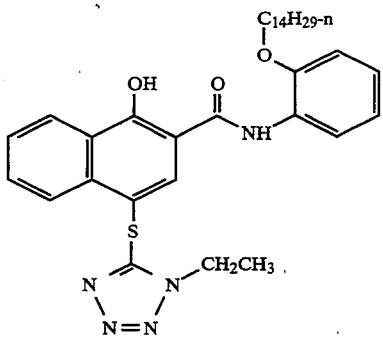
COM DIR-3
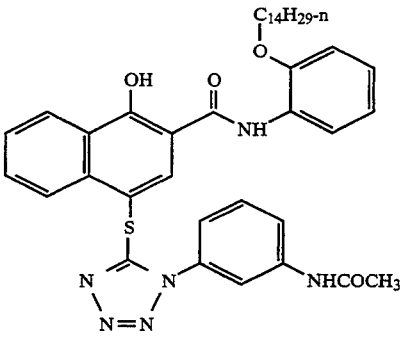
COM DIR-4
COM DIR-5

-continued
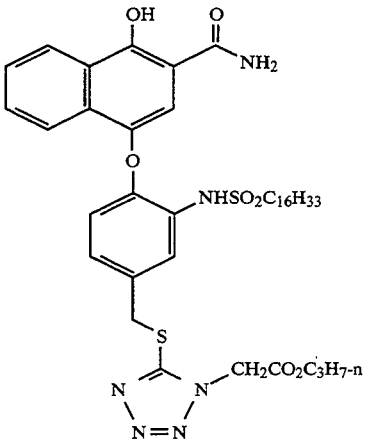
Antifoggant
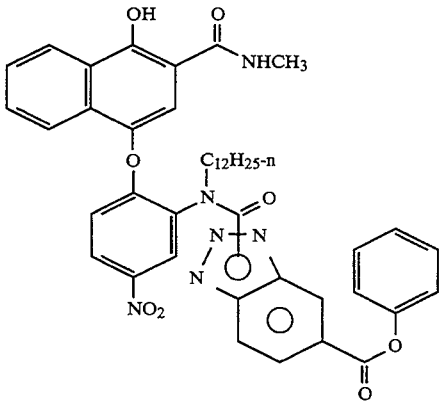
C-1
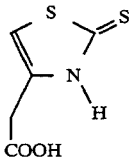
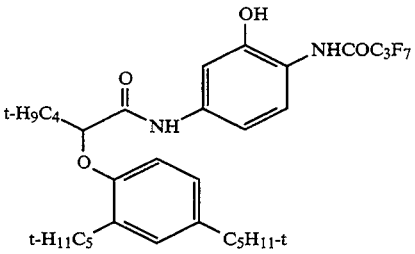
M-1
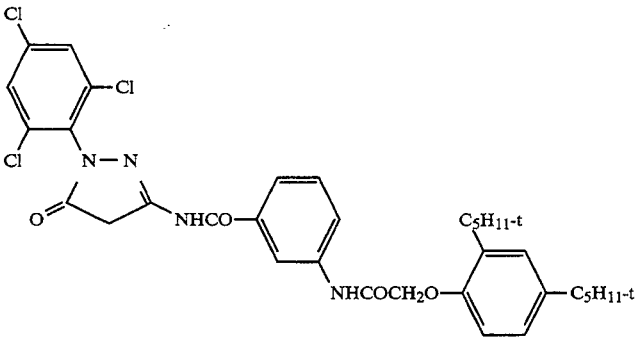
M-2
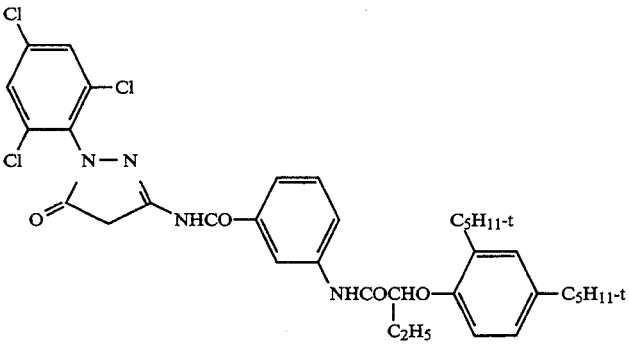
Y-1
S1

-continued
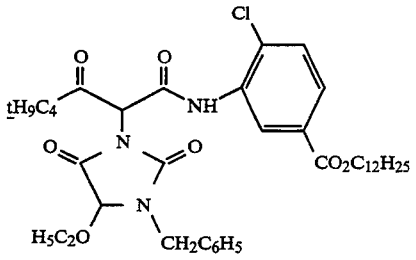
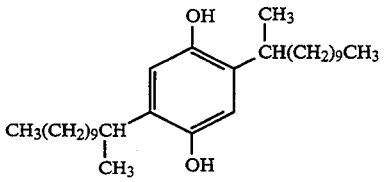
S2
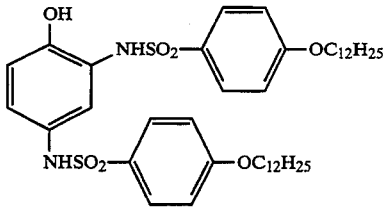
S-3
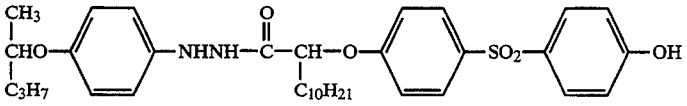
DYE-1
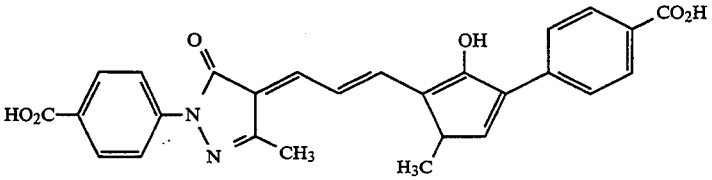
SENSITIZING DYE-1
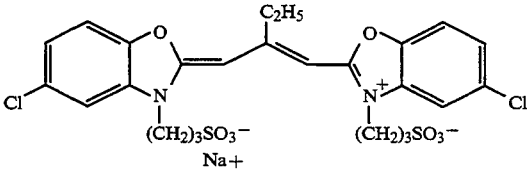
SENSITIZING DYE-2
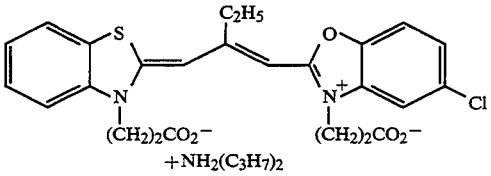
Cyan Absorber Dye
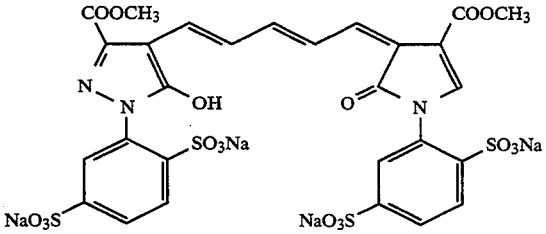
Magenta Absorber Dye
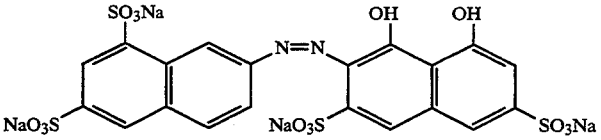
Yellow Absorber Dye -continued

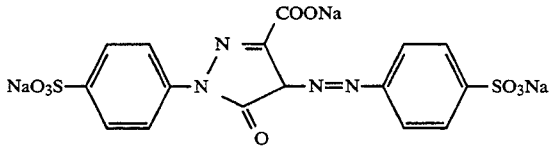

In a similar fashion samples 102 to 109 were prepared except that DIR-2 was replaced with equimolar amounts of the DIR as indicated in Table 1. After drying, the samples were slit into 12 inch×35 mm strips and exposed as follows:

First, the red-sensitive layer was exposed in an image-wise fashion to a 0–3 density step tablet plus a Wratten 29 filter using a commercial sensitometer (3000 k lamp temperature) for 0.01 sec. The green-sensitive layer was then given a uniform flash exposure using the same sensitometer with a Wratten 99 filter, but without the step tablet. The intensity of the green exposure was selected to be that which gave a Status A green analytical maximum density of approximately 2.0, after photographic processing, for sample 100, which was identical in composition to sample 101 except that it contained no DIR. The exposed samples were processed according to the sequence described above. All solutions of the above process were held at a temperature of 36.9° C. The compositions of the processing solution are the same as described above.

After processing, the densities of the samples were read to status A densitometry using a commercial densitometer. The densities were converted to analytical densities in the usual manner so that the red and green densities reflected the amount of cyan and magenta dyes formed in the respective layers. The results are tabulated in Table 2, and the inhibitor strengths of the INH moieties released from the DIR compounds during color development are shown in Table 1. It can be seen that the DIR compounds of this invention that release INH moieties having inhibitor strengths greater than 1.00 produce greater reductions in the red maximum density than do the comparison DIR compounds that release INH fragments having inhibitor strengths less than 1.00. The ability to reduce the density in the layer in which the DIR compound is coated is an indication of DIR compound's ability to produce sharpness improvements. Also recorded in Table 2 is a parameter called Delta $D_{max}$ ($\Delta D_{max}$), which is the difference in the green density measured in an area of the film strip where the red density is a maximum, minus the green density measured in an area where the red density is a minimum. As such, this parameter reflects the ability of a DIR compound coated in one layer to alter the dye formation in another layer. The data in Table 2 shows that DIR compounds of this invention, which release INH moieties that have inhibitor strengths greater than 1, have a substantially greater effect on the dye density formed in the green sensitive layer than do comparison DIR compounds that release INH moieties having inhibitor strengths less than 1. This very desirable property enables the preparation of color reversal elements that have enriched color saturation.

TABLE 1

| Sample | INH | IS |
|---|---|---|
| 100 | none | — |
| 101 | INH-1 | 1.77 |
| 102 | INH-3 | 1.67 |

TABLE 1-continued

| Sample | INH | IS |
|---|---|---|
| 103 | INH-12 | 1.95 |
| 104 | INH-13 | 2.11 |
| 105 | COM INH-1 | 1.00 |
| 106 | COM INH-2 | 0.05 |
| 107 | COM INH-3 | 0.24 |
| 108 | COM INH-4 | 0.00 |
| 109 | COM INH-5 | 0.00 |

TABLE 2

| Sample | DIR | INH in DIR | Red $D_{max}$ | $\Delta D_{max}$ (Green) |
|---|---|---|---|---|
| 100 | none | — | 3.15 | 0.21 |
| 101 | DIR-1 | INH-1 | 2.76 | 0.46 |
| 102 | DIR-23 | INH-3 | 1.67 | 0.41 |
| 103 | DIR-25 | INH-12 | 2.23 | 0.40 |
| 104 | DIR-24 | INH-13 | 1.82 | 0.68 |
| 105 | COM DIR-1 | COM INH-1 | 3.12 | 0.40 |
| 106 | COM DIR-2 | COM INH-2 | 3.21 | 0.20 |
| 107 | COM DIR-3 | COM INH-3 | 3.19 | 0.22 |
| 108 | COM DIR-4 | COM INH-4 | 3.21 | 0.29 |
| 109 | COM DIR-5 | COM INH-5 | 3.20 | 0.30 |

The following examples further illustrate the advantages of the present invention in using a combination of a DIR with an absorber dye:

EXAMPLE 2

Using cellulose triacetate film supports, four multilayer color light sensitive elements, each having the following basic layer construction, were constructed according to the basic layer arrangement below. Silver halide emulsion particle size is given as average diameter×average thickness, both in μm. All amounts are in g/m² unless otherwise indicated. Amounts of silver halide are given as amounts of silver.

First layer. An antihalation layer containing 0.431 g/m² black colloidal silver in 2.41 g/m² gelatin.

Second layer. An intermediate layer containing 1.22 g/m² gelatin.

Third layer. A first red sensitive emulsion layer containing:

| | |
|---|---|
| cyan dye forming coupler (CC-1) | 0.161 |
| solvent-4 | 0.081 |
| silver bromoiodide. (3% I, 484 mg/m², 0.54 × 0.0097) | 0.431 |
| red sensitizing dyes RDYE-1 and RDYE-2 | |
| gelatin | 0.861 |

Fourth layer. A second red sensitive emulsion layer containing:

| | |
|---|---|
| cyan dye forming coupler (CC-1) | 0.969 |
| solvent-4 | 0.484 |
| silver bromoiodide (3% I, 538 mg/m², 0.73 × 0.089) | 0.595 |
| DIAR-A coupler as described below | |
| red sensitizing dyes RDYE-1 and RDYE-2 | |
| gelatin | 1.507 |

Fifth layer. An intermediate layer containing:

| | |
|---|---|
| competitor-2 | 0.161 |
| solid particle magenta filter dye (FDYE-1) | 0.065 |
| gelatin | 0.614 |

Sixth layer. An intermediate layer containing:

| | |
|---|---|
| gelatin | 0.614 |

Seventh layer. A first green sensitive emulsion layer containing:

| | |
|---|---|
| magenta dye forming coupler (MC-1) | 0.113 |
| magenta dye forming coupler (MC-2) | 0.048 |
| solvent-3 | 0.081 |
| silver bromoiodide (4% I, 484 mg/m$^2$, 0.40 × 0.057) | 0.431 |
| green sensitizing dyes GDYE-1 and GDYE-2 | |
| gelatin | 0.861 |

Eighth layer. A second green sensitive emulsion layer containing:

| | |
|---|---|
| magenta dye forming coupler (MC-1) | 0.678 |
| magenta dye forming coupler (MC-2) | 0.291 |
| solvent-3 | 0.484 |
| silver bromoiodide (4% I, 484 mg/m$^2$, 0.94 × 0.111) | 0.538 |
| green sensitizing dyes GDYE-1 and GDYE-2 | |
| gelatin | 1.507 |

Ninth layer. An intermediate layer containing:

| | |
|---|---|
| gelating | 0.614 |

Tenth layer. An intermediate layer containing:

| | |
|---|---|
| competitor-2 | 0.108 |

-continued

| | |
|---|---|
| solid particle yellow filter dye (FDYE-2) | 0.269 |
| gelatin | 0.614 |

Eleventh layer. A first blue sensitive emulsion layer containing:

| | |
|---|---|
| yellow dye forming coupler (YC-1) | 0.323 |
| solvent-4 | 0.108 |
| silver bromoiodide (4% I, 376 mg/m$^2$, 0.65 × 0.10) | 0.323 |
| blue sensitizing dye (BDYE-1) | |
| gelatin | 0.861 |

Twelfth layer. A second blue sensitive emulsion layer containing:

| | |
|---|---|
| yellow dye forming coupler (YC-1) | 0.561 |
| solvent-4 | 0.520 |
| silver bromoiodide (3% I, 538 mg/m$^2$, 1.58 × 0.13) | 0.484 |
| blue sensitizing dye (BDYE-1) | |
| gelatin | 2.368 |

Thirteenth layer. A first protective layer containing: ultraviolet absorbers

| | |
|---|---|
| gelatin | 1.399 |

Fourteenth layer. A second protective layer containing:

| | |
|---|---|
| Bis(vinylsulfonylmethane) | 0.257 |
| matte | 0.018 |
| fine grain AgBr | 0.120 |
| gelating | 0.969 |

absorber dyes as described below.

The structures of some of the components of the foregoing film element are listed below:

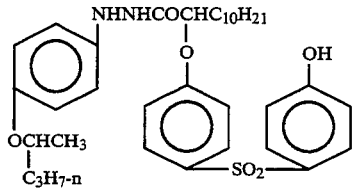

Competitor 2

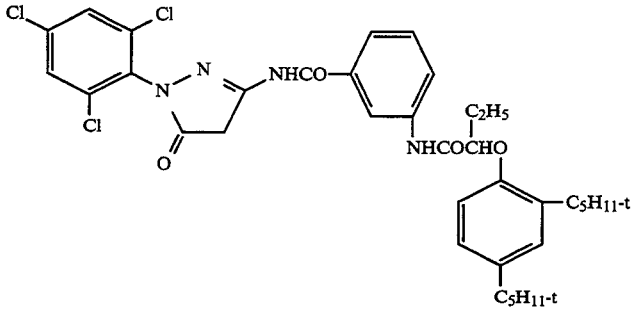

Coupler MC-1

-continued

Coupler MC-2

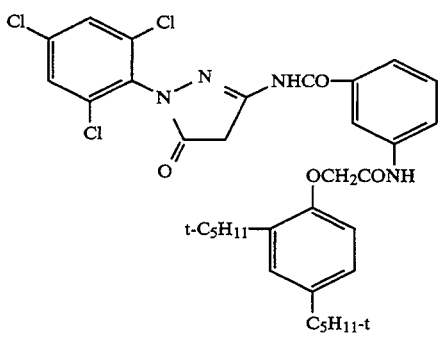

Coupler YC-1

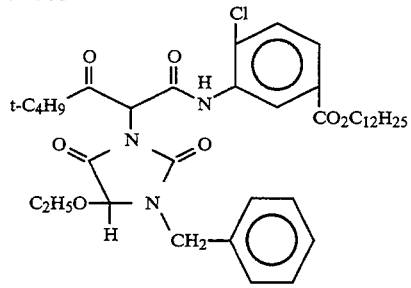

Coupler CC-1

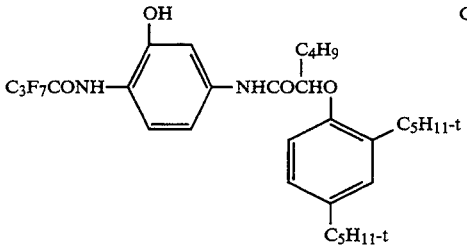

GDYE-1

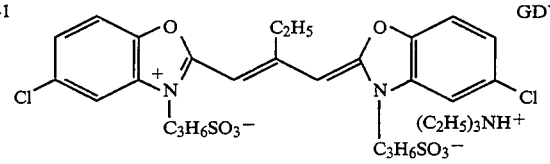

GDYE-2

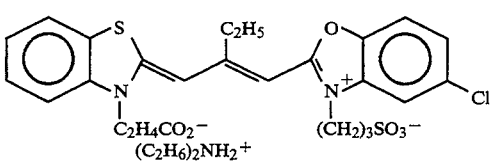

RDYE-1

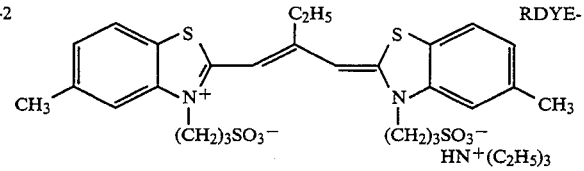

RDYE-2

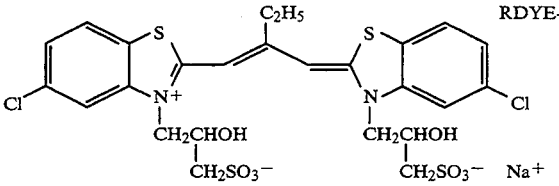

BDYE-1

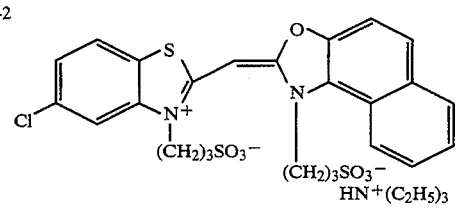

FDYE-2

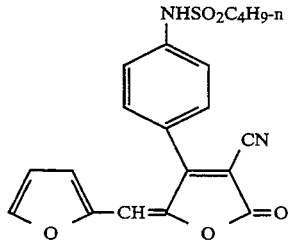

FDYE-1

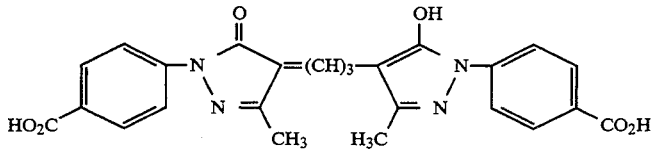

Solvent-3 = tritolyl phosphates
Solvent-4 = dibutylphthalate

Elements designated 01 and 04 (see Table 3 below) additionally contained DIAR-A in the fourth layer while samples designated 03 and 04 did not contain DIAR-A. Also, elements 02 and 03 additionally contained absorber dyes in the fourteenth layer while elements 01 and 04 contained no absorber dyes. The absorber dyes in elements 02 and 03 were 248 mg/m$^2$ of blue absorbing dye ABSDYE-1 plus 37.6 mg/$^2$ of red absorbing dye ABSDYE-2, plus 69.9 mg/$^2$ of green absorbing dye 4,5-dihydroxy 3-(6',8'-disulfo-2'-naptho azo)-2,7-naphthalene disulfonic acid (na salt) (referred to as ABSDYE-3). Thus, only element 2 is an element of the present invention since only it has both an absorber dye and a development inhibiting compound present. Note that when the three foregoing particular absorber dyes are used in other elements, preferred ranges would be from 0.03 to 0.5 g/m$^2$ for ABSDYE-1, 0.005 to 0.05 g/m$^2$ for ABSDYE-2, and 0.01 to 0.1 g/m$^2$ for ABSDYE-3.

The above elements were exposed to simulated daylight and processed through Kodak Process E6. The image sharpness was evaluated by determining the modulation transfer function and calculating the cascaded MTF response for 35 mm Slide. The MTF values were obtained as described in R. L. Lamberts and F. C. Eisen, Journal of Applied Photographic Engineering, Vol. 6, Feb. 1980., p. 1–8, titled "A System for Automated Evaluation of Modulation Transfer Functions of Photographic Materials". Reference for the method of determining CMT values from the data. E. M. Crane, J. Soc Mot. Pic. Tel. Eng., 73, 643, (1964). CMT values were calculated using the following formula in which the cascaded area under the system modulation curve is shown in equation (21.104) on p. 629 of T. H. James, ed., *The Theory of the Photographic Process,* 4th Edition, Macmillan, New York, 1977:

CMT=100+42 log [cascaded area/5.4782M] where the magnification factor M=3.36 (35 mm slide). The photographic speed was determined by exposing through a step tablet. The ANSI standard speeds for elements 01 and 04 are both 100 while the speed for elements 02 and 03 are both 50 (that is, elements 02 and 03 have been dyed back to the resulting 50 speed). The 35 mm slide CMT results are listed in Table 3.

The data show the same acutance gains from the absorber dyes with or without DIAR-A. As can be seen from the data, the combination of the development inhibitor compound and absorber dye gave acutance gains that exceeded that provided by each of those separately.

Table 4 shows that DIAR-A preferentially improves the film's green acutance at low spatial frequencies as measured by the MTF number at 10 cycles/mm. Little improvement is seen at the high spatial frequency of 60 c/mm. In addition, this particular DIAR shows little effect on the red and blue acutance at any frequency. The absorber dyes improve the films green and red MTF non-selectively at both low and high spatial frequencies. But the absorber dyes selectively improve the blue MTF preferentially at 60 c/mm. Thus, appropriate combinations of DIR plus absorber dyes allow some selective control over the spatial frequency range over which the acutance improvement occurs. Note that the present invention may therefore be useful in tuning reproduction characteristics of a film such as described in U.S. Patent Application for "Color Photographic Reversal Element with Improved Color Reproduction", Attorney Docket No. 61940, by Ford et al., filed on the same date as the present application and incorporated herein by reference.

TABLE 3

| Acutance Gain from DIAR-A and/or Absorber Dyes | | | |
|---|---|---|---|
| Element | Red | Green | Blue |
| 0.043 g/m$^2$ DIAR-A in fourth layer | | | |
| 01 (no dyes) | 97.4 | 99.6 | 97.9 |
| 02 (dyes present) | 99.5 | 100.9 | 99.0 |
| Change | +2.1 | +1.3 | +1.1 |
| No DIAR-A in fourth layer | | | |
| 04 (no dyes) | 97.2 | 98.5 | 97.6 |
| 03 (dyes present) | 99.3 | 99.8 | 98.7 |
| Change | +2.1 | +1.3 | +1.1 |

TABLE 4

| MTF Data from DIAR-A Plus Absorber Dyes | | | |
|---|---|---|---|
| Element | Red | Green | Blue |
| MTF at 10 c/mm (low frequency) | | | |
| 04 (no dyes; no DIAR) | 96 | 102 | 96 |
| 01 (no dyes; DIAR present) | 96 | 109 | 98 |
| change | 0 | +7 | +2 |
| 04 (no dyes; no DIAR) | 96 | 102 | 96 |
| 03 (dyes present; no DIAR) | 109 | 110 | 100 |
| change | +13 | +8 | +4 |
| 04 (no dyes; no DIAR) | 96 | 102 | 96 |
| 02 (dyes present; DIAR present) | 110 | 118 | 103 |
| change | +14 | +16 | +7 |

Structures of the compounds referred to in the Examples are:

DIAR-A

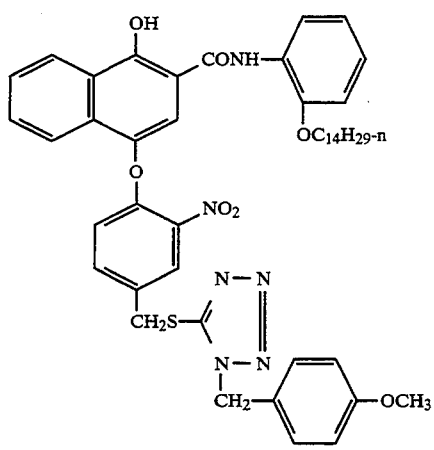

ABSDYE-1

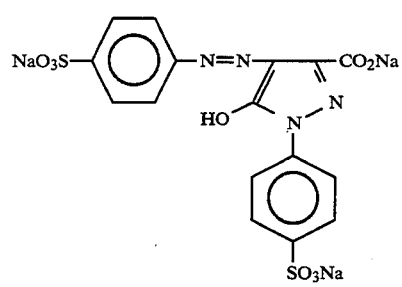

ABSDYE-2

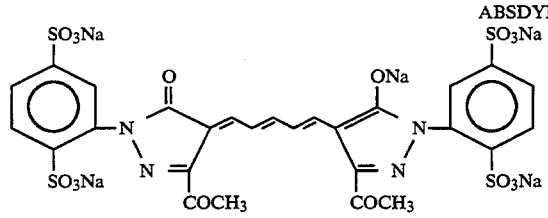

ABSDYE-3

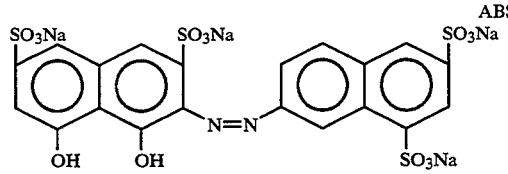

EXAMPLE 3

To demonstrate the effectiveness of the present invention with polymorphic (3 D) grains, four multilayer color light sensitive elements (numbered 5–8), each having the following basic layer construction, were constructed according to layer arrangement below:

On a cellulose triacetate support provided with a subbing layer was coated each layer having the composition set forth below. In the composition of the layers, the coating amounts are shown as g/m$^2$ except for sensitizing dyes, which are shown as the molar amount per mole of silver halide present in the same layer. Note that Competitor-2, the absorber dyes, and couplers CM-1, CM-2, CY-1, and CC-1 are the same as in Example 2 above. Structures for other components are provided below.

First layer: Antihalation Layer

| | |
|---|---|
| Black Colloidal Silver | 0.43 (as silver) |
| Gelatin | 2.44 |

Second layer: Intermediate Layer

| | |
|---|---|
| Gelatin | 1.22 |

Third layer: Slow Red Sensitive Layer ("SR")

| | |
|---|---|
| Silver iodobromide emulsions (total) | 0.41 (as silver) |
| Red sensitizing dyes | $0.65 \times 10^{-3}$ |
| Cyan coupler CC-1 | 0.42 |
| Solvent-4 | 0.21 |
| Gelatin | 1.52 |

Fourth Layer: Fast Red Sensitive Layer ("FR")

| | |
|---|---|
| Silver iodobromide emulsion | 0.83 (as silver) |
| Red sensitizing dyes | $0.35 \times 10^{-3}$ |
| Cyan coupler CC-1 | 0.89 |
| Solvent-4 | 0.45 |
| Gelatin | 1.44 |

Fifth Layer: Intermediate Layer

| | |
|---|---|
| Competitor-1 | 0.145 |
| Gelatin | 0.61 |
| Antifoggant-1 | 0.00051 |
| Absorber dye ABSDYE-1 in amounts as described below | |

Sixth Layer: Slow Green Sensitive Layer ("SG")

| | |
|---|---|
| Silver iodobromide emulsions (total) | 0.42 (as silver) |
| Green sensitizing dyes | $1.21 \times 10^{-3}$ |
| Coupler MC-2 | 0.14 |
| Coupler MC-1 | 0.32 |
| Solvent-3 | 0.18 |
| Gelatin | 2.21 |

Seventh Layer: Fast Green Sensitive Layer ("FG")

| | |
|---|---|
| Silver iodobomide emulsion | 0.79 (as silver) |
| Green Sensitizing Dyes | $0.70 \times 10^{-3}$ |
| Coupler MC-2 | 0.23 |
| Coupler MC-1 | 0.53 |
| Solvent-3 | 0.39 |
| Gelatin | 1.73 |

Eighth Layer: Intermediate Layer

| | |
|---|---|
| Absorber dyes ABSDYE-2 and ABSDYE-3 in amounts as described below | |
| Gelatin | 0.61 |
| Ninth Layer: Yellow Filter Layer | |
| Yellow Colloidal Silver | 0.07 (as silver) |
| Competitor-2 | 0.11 |
| Gelatin | 0.61 |

Tenth Layer: Slow Blue Sensitive Layer ("SB")

| | |
|---|---|
| Silver iodobromide emulsions (total) | 0.57 (as silver) |
| Blue Sensitizing dye | $0.17 \times 10^{-3}$ |
| Coupler YC-1 | 0.73 |
| Solvent-4 | 0.24 |
| Gelatin | 1.35 |

Eleventh Layer: Fast Blue Sensitive Layer ("FB")

| | |
|---|---|
| Silver iodobromide emulsion | 1.07 (as silver) |
| Blue sensitizing dye | $0.30 \times 10^{-3}$ |
| Coupler YC-1 | 1.60 |
| Solvent-4 | 0.53 |
| Gelatin | 2.69 |

Twelfth Layer: First Protective Layer

| | |
|---|---|
| Ultraviolet Absorbing Dyes | 0.51 |
| Gelatin | 1.40 |

Thirteenth Layer: Second Protective Layer

| | |
|---|---|
| Fine grain silver bromide emulsion | 0.12 (as silver) |
| Matte | 0.02 |
| Bis(vinylsulfonylmethane) | 0.29 |
| Gelatin | 0.97 |

Solvent-3 = tritolyl phosphates

Solvent-4 = dibutylphthalate

The equivalent circular diameter ("ECD") and iodide content of the emulsions used are listed below. Note that layers 3, 6 and 10 used a combination of coarser and finer grain emulsions. All emulsions were polymorphic.

| Layer | Average ECD (μm) | Iodide % |
|---|---|---|
| 11 | .98 | 2 |
| 10 | .50 | 3.4 |
| 10 | .33 | 3.4 |
| 7 | .60 | 2 |
| 6 | .25 | 4.8 |
| 6 | .16 | 4.8 |
| 4 | .65 | 3.4 |
| 3 | .25 | 4.8 |
| 3 | .16 | 4.8 |

Formulae for the DIAR-B compound additionally used, and for other compounds in the above are listed below.

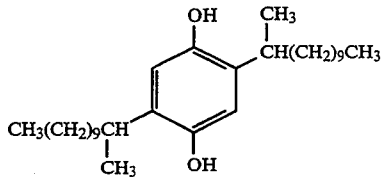

COMPETITOR 1

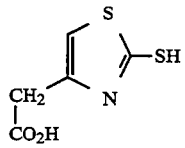

Antifoggant 1

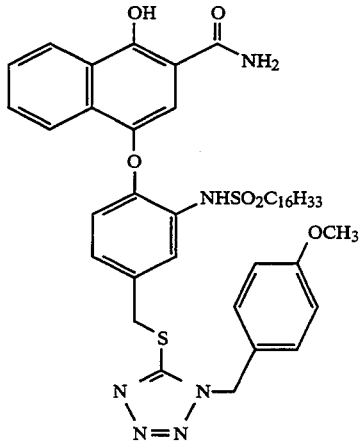

DIAR-B

Elements 5 and 6 additionally contained DIAR-B in the fourth layer at 0.032 g/m$^2$ while elements 7 and 8 did not contain DIAR-B. All of elements 5–8 contained all three absorber dyes, ABSDYE-1, ABSDYE-2 and ABSDYE-3 in the layers as indicated in the above film structure. Elements 5 and 7 had an ANSI speed standard of 100 and contained lower levels of the dyes ("low dyes"), namely ABSDYE-1 at 0.205 g/m$^2$, ABSDYE-2 at 0.008 g/m$^2$, and ABSDYE-3 at 0.016 g/m$^2$. Elements 6 and 8 were both dyed back to an ANSI speed standard of 50, and contained higher levels of the dyes ("high dyes"), namely ABSDYE-1 at 0.431 g/m$^2$, ABSDYE-2 at 0.030 g/m$^2$, and ABSDYE-3 at 0.069 g/m$^2$. Elements 5–8 were exposed, processed and evaluated as in Example 2. The results are provided in Tables 5 and 6 below

TABLE 5

| Acutance Gain From DIAR-B and/or Absorber Dyes | | | |
|---|---|---|---|
| Element | Red | Green | Blue |
| 0.032 g/m$^2$ DIAR-B in fourth layer | | | |
| 05 (low dyes) | 94.2 | 97.0 | 98.0 |
| 06 (high dyes) | 95.8 | 98.6 | 98.6 |
| Change | +1.6 | +1.6 | +0.6 |
| No DIAR-B in fourth layer. | | | |
| 07 (low dyes) | 93.9 | 96.6 | 97.8 |
| 08 (high dyes) | 95.1 | 98.1 | 98.3 |
| Change | +1.2 | +1.5 | +0.5 |

TABLE 6

| MTF Data from DIAR-B Plus Absorber Dyes | | | |
|---|---|---|---|
| Element | Red | Green | Blue |
| MTF at 10 c/mm (low frequency). | | | |
| 07 (low dyes, no DIAR-B) | 80 | 97 | 99 |
| 05 (low dyes, DIAR-B present) | 83 | 100 | 99 |

TABLE 6-continued

| MTF Data from DIAR-B Plus Absorber Dyes | | | |
|---|---|---|---|
| Element | Red | Green | Blue |
| Change | +3 | +3 | 0 |
| 07 (low dyes, no DIAR-B) | 80 | 97 | 99 |
| 08 (high dyes, no DIAR-B) | 86 | 103 | 101 |
| Change | +6 | +6 | +2 |
| 07 (low dyes, no DIAR-B) | 80 | 97 | 99 |
| 06 (high dyes, DIAR-B present) | 92 | 107 | 102 |
| Change | +8 | +10 | +3 |
| MTF at 60 c/mm (high frequency) | | | |
| 07 (low dyes, no DIAR-B) | 7 | 18 | 40 |
| 05 (low dyes, DIAR-B present) | 7 | 18 | 40 |
| Change | 0 | 0 | 0 |
| 07 (low dyes, no DIAR-B) | 7 | 18 | 40 |
| 08 (high dyes, no DIAR-B) | 8.5 | 25 | 47 |
| Change | +1.5 | +7 | +7 |
| 07 (low dyes, no DIAR-B) | 7 | 18 | 40 |
| 06 (high dyes, DIAR-B present) | 9.5 | 24 | 47 |
| Change | +2.5 | +6 | +7 |

The invention has been described in detail with particular reference to preferred embodiments, but it will be understood that variations and modifications can be effected within the spirit and scope of the invention.

What is claimed is:

1. A method of processing a reversal photographic element wherein the element has:

a) a light sensitive layer containing latent image forming silver halide grains;

b) an inhibitor containing compound in the light sensitive layer or a non-imaging layer associated with the light sensitive layer, the compound having the structural formula $$\text{CAR-(TIME)}_n\text{-INH}$$

wherein:

CAR is a carrier moiety from which -(TIME)$_n$-INH is released during color development;

TIME is a timing group;

INH is comprised of a development inhibitor moiety selected from the group consisting of oxazole, thiazole, diazole, oxadiazole, oxathiazole, triazole, thiatriazole, benzotriazole, tetrazole, benzimidazole, indazole, isoindazole, mercaptotriazole, mercaptotetrazole, selenotetrazole, mercaptothiazole, selenobenzothiazole, mercaptobenzoxazole, selenobenzoxazole, mercaptobenzimidazole, selenobenzimidazole, benzodiazole, mercaptooxadiazole, or benzisodiazole, the INH having an inhibitor potency greater than 1;

n is 0, 1 or 2;

wherein inhibitor potency, IS, of the INH compound is defined as:

$$IS = \frac{IN_{(test)}}{IN_{(control)}}$$

where IN$_{(test)}$ is the inhibitor number of INH and IN$_{(control)}$ is the inhibitor number for 1-phenyl-5-mercapto-1,2,3,4-tetrazole.

c) a dye which absorbs light to which the light sensitive layer is sensitive;

the method comprising first treating the element with a black and white developer to develop exposed silver halide grains, then fogging non-exposed silver halide grains, then treating the element with a color developer.

2. A method according to claim 1 wherein the dye of the photographic element is a diffusible dye.

3. A method according to claim 1 additionally comprising a support and wherein the dye of the photographic element is positioned in a layer further from the support than the light sensitive layer.

4. A method according to claim 1 wherein the light sensitive layer of the photographic element is sensitive to red light and the dye is a red absorbing dye.

5. A method according to claim 1 wherein the inhibitor containing compound of the photographic element is located in the light sensitive layer.

6. A method according to claim 1 wherein CAR is a coupler which reacts with oxidized color developer to form a dye while simultaneously releasing -(TIME)$_n$-INH.

7. A method according to claim 1 wherein the light sensitive layer is sensitive to green light and the dye is a green absorbing dye.

8. A method according to claim 6 wherein the light sensitive layer contains a color coupler.

9. A method of processing a color reversal photographic element wherein the element has:

a) a red sensitive layer containing a cyan coupler, a green sensitive layer containing a magenta coupler and a blue sensitive layer containing a yellow coupler, each layer containing latent image forming silver halide grains;

b) an inhibitor containing compound in the red, green or blue sensitive layer or a non-imaging layer associated with one of the those layers, the compound having the structural formula CAR-(TIME)$_n$-INH wherein:

CAR is a carrier moiety from which -(TIME)$_n$-INH is released during color development;

TIME is a timing group;

INH is comprised of a development inhibitor moiety selected from the group consisting of oxazole, thiazole, diazole, oxadiazole, oxathiazole, triazole, thiatriazole, benzotriazole, tetrazole, benzimidazole, indazole, isoindazole, mercaptotriazole, mercaptotetrazole, selenotetrazole, mercaptothiazole, selenobenzothiazole, mercaptobenzoxazole, selenobenzoxazole, mercaptobenzimidazole, selenobenzimidazole, benzodiazole, mercaptooxadiazole, or benzisodiazole, the INH having an inhibitor potency greater than 1;

n is 0, 1 or 2;

wherein inhibitor potency, IS, of the INH compound is defined as:

$$IS = \frac{IN_{(test)}}{IN_{(control)}}$$

where $IN_{(test)}$ is the inhibitor number of INH and $IN_{(control)}$ is the inhibitor number for 1-phenyl-5-mercapto-1,2,3,4-tetrazole;

c) a dye which absorbs red, green or blue light; the method comprising first treating the element with a black and white developer to develop exposed silver halide grains, then fogging non-exposed grains, then treating the element with a color developer.

10. A method according to claim 9 wherein the dye of the photographic element is a diffusible dye.

11. A method according to claim 9 wherein the photographic element additionally comprises a support and wherein the dye of the photographic element is positioned in a layer further from the support than that which is sensitive to light which the dye absorbs.

12. A method according to claim 9 additionally comprising a support and wherein the dye of the photographic element absorbs red light and is positioned in a layer further from the support than the red sensitive layer.

13. A method according to claim 9 wherein the inhibitor containing compound of the photographic element is in the red, green or blue sensitive layer.

14. A method according to claim 9 wherein the inhibitor containing compound of the photographic element is in the red sensitive layer.

15. A method according to claim 9 wherein CAR is a coupler which reacts with oxidized color developer to form a dye while simultaneously releasing -(TIME)$_n$-INH.

* * * * *